US006856775B2

(12) United States Patent
Sekine

(10) Patent No.: US 6,856,775 B2
(45) Date of Patent: Feb. 15, 2005

(54) REMANUFACTURING METHOD FOR A PROCESS CARTRIDGE AND PROCESS CARTRIDGE HAVING A DRUM, A DRUM FRAME, A DEVELOPING FRAME, A DEVELOPER FRAME, SIDE COVERS, AN IMAGE TRANSFER OPENING, AND A DRUM SUPPORTING SHAFT

(75) Inventor: Kazumi Sekine, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 10 days.

(21) Appl. No.: 10/128,249

(22) Filed: Apr. 24, 2002

(65) Prior Publication Data

US 2002/0181967 A1 Dec. 5, 2002

(30) Foreign Application Priority Data

Apr. 27, 2001 (JP) ..... 2001/132749

(51) Int. Cl.[7] ..... G03G 15/00
(52) U.S. Cl. ..... 399/109
(58) Field of Search ..... 399/109, 110, 399/113

(56) References Cited

U.S. PATENT DOCUMENTS

| | | | | |
|---|---|---|---|---|
| 5,331,372 A | | 7/1994 | Tsuda et al. | 355/200 |
| 5,404,198 A | | 4/1995 | Noda et al. | 355/200 |
| 5,470,635 A | | 11/1995 | Shirai et al. | 429/131 |
| 5,475,470 A | | 12/1995 | Sasago et al. | 355/210 |
| 5,488,459 A | | 1/1996 | Tsuda et al. | 355/211 |
| 5,510,878 A | | 4/1996 | Noda et al. | 355/211 |
| 5,537,187 A | | 7/1996 | Sekine | 355/200 |
| 5,583,613 A | | 12/1996 | Kobayashi et al. | 355/200 |
| 5,602,623 A | | 2/1997 | Nishibata et al. | 399/111 |
| 5,608,509 A | | 3/1997 | Shirai et al. | 399/351 |
| 5,623,328 A | | 4/1997 | Tsuda et al. | 399/111 |
| 5,659,847 A | | 8/1997 | Tsuda et al. | 399/113 |
| 5,669,042 A | | 9/1997 | Kobayashi et al. | 399/111 |
| 5,768,660 A | | 6/1998 | Kurihara et al. | 399/111 |
| 5,809,374 A | | 9/1998 | Tsuda et al. | 399/111 |
| 5,828,928 A | | 10/1998 | Sasago et al. | 399/111 |
| 5,870,654 A | * | 2/1999 | Sato et al. | 399/109 |
| 6,009,289 A | | 12/1999 | Sekine et al. | 399/113 |
| 6,519,430 B2 | * | 2/2003 | Higeta et al. | 399/109 |
| 2002/0034398 A1 | * | 3/2002 | Higeta et al. | 399/109 |
| 2002/0037178 A1 | * | 3/2002 | Saitoh et al. | 399/110 |
| 2002/0041774 A1 | * | 4/2002 | Higeta et al. | 399/109 |
| 2002/0159787 A1 | * | 10/2002 | Chadari et al. | 399/109 |
| 2002/0159788 A1 | * | 10/2002 | Miyabe et al. | 399/109 |
| 2002/0172528 A1 | * | 11/2002 | Sekine | 399/109 |

FOREIGN PATENT DOCUMENTS

JP 2001-122361 * 5/2001

* cited by examiner

*Primary Examiner*—Quana Grainger
(74) *Attorney, Agent, or Firm*—Fitzpatrick, Cella, Harper & Scinto

(57) ABSTRACT

A remanufacturing method for a process cartridge including: (a) a first step of forming a first hole in a second side cover around a second shaft portion of a drum supporting shaft; (b) a drum shaft removing step of removing the drum supporting shaft from a drum frame by operation through the first hole; (c) a photosensitive drum removing step of removing an electrophotographic photosensitive drum from the drum frame through a transfer opening; (d) a photosensitive drum insertion step of inserting the electrophotographic photosensitive drum into the drum frame through the transfer opening; (e) a drum shaft mounting step of mounting the drum supporting shaft on the drum frame; and (f) a refilling step of filling developer in the developer frame.

10 Claims, 16 Drawing Sheets

REMANUFACTURING METHOD FOR A PROCESS CARTRIDGE AND PROCESS CARTRIDGE HAVING A DRUM, A DRUM FRAME, A DEVELOPING FRAME, A DEVELOPER FRAME, SIDE COVERS, AN IMAGE TRANSFER OPENING, AND A DRUM SUPPORTING SHAFT

FIELD OF THE INVENTION AND RELATED ART

The present invention relates to a process cartridge remanufacturing method. Here, a process cartridge is a cartridge in which a minimum of a developing means and an electrophotographic photoconductive member are integrally disposed, and which is removable mountable in the main assembly of an electrophotographic image forming apparatus.

An electrophotographic image forming apparatus includes an electrophotographic copying machine, an electrophotographic printer(for example, an LED printer, a laser beam printer, and the like), an electrophotographic facsimile, an electrophotographic word processor, and the like.

In an electrophotographic image forming apparatus, a process cartridge system has long been employed. According to this system, an electrophotographic photoconductive member, and a single or plurality of processing means, which act on the electrophotographic photoconductive member, are integrated into a form of a cartridge removably mountable in the main assembly of the image forming apparatus. This system enables a user him/her self to maintain the apparatus without relying on a service person, immensely improving the operability of the apparatus. Thus, the process cartridge system has been widely used in the field of an image forming apparatus.

A process cartridge such as the one described above forms an image on a recording medium with the use of developer (toner) contained therein. Therefore, the amount of the developer therein gradually decreases with image formation, eventually to a level below which it fails to form an image satisfactory in quality to the user who purchased the process cartridge. At this point, the process cartridge loses its commercial value.

Thus, it has long been desired to realize a simple method for remanufacturing a process cartridge so that a process cartridge which has lost its commercial value due to the depletion of the developer therein can be marketed again.

SUMMARY OF THE INVENTION

The primary object of the present invention is to provide a simple method for remanufacturing a process cartridge.

Another object of the present invention is to provide a method for remanufacturing a process cartridge, the commercial value of which has been lost due to the consumption of the developer therein to a level below which the process cartridge fails to forms an image satisfactory in quality to a user who has purchased the process cartridge.

According to an aspect of the present invention, there is provided a remanufacturing method for a process cartridge, wherein the process cartridge is detachably mountable to a main assembly of an electrophotographic image forming apparatus. The process cartridge includes: an electrophotographic photosensitive drum having, at one longitudinal end, a drive receiving portion for receiving a driving force from the main assembly of the electrophotographic image forming apparatus; a drum frame rotatably supporting the electrophotographic photosensitive drum; a developing frame for supporting a developing roller for developing a latent image formed on the electrophotographic photosensitive drum; a developer frame accommodating a developer to be used for a developing operation of the developing roller; a first side cover fixed to one longitudinal end of the drum frame and the developer frame; and a second side cover fixed to the other ends of the drum frame and the developer frame; an image transfer opening formed along a longitudinal direction of the electrophotographic photosensitive drum for permitting transfer of a visualized image provided by the developing roller onto a recording material; a drum supporting shaft having a first shaft portion inserted through a flange portion fixed to the drum frame and the electrophotographic photosensitive drum at the other end of the drum frame, and a second shaft portion extending out of the second side cover through an opening formed therein and extended oppositely from the first shaft portion with the flange portion therebetween. The method comprises: (a) a first hole forming step of forming a hole in the second side cover around the second shaft portion of the drum supporting shaft; (b) a drum shaft removing step of removing the drum supporting shaft from the drum frame through the first hole formed by the first hole forming step; (c) a photosensitive drum removing step of removing the electrophotographic photosensitive drum from the drum frame through the transfer opening; (d) a photosensitive drum insertion step of inserting the electrophotographic photosensitive drum into the drum frame through the transfer opening; (e) a drum shaft mounting step of mounting the drum supporting shaft on the drum frame; and (f) a refilling step of filling developer in the developer frame.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention will be described with reference to FIGS. 1–9. In the following embodiments, the lengthwise direction is a direction which is perpendicular to the recording medium conveyance direction, and is parallel to the surface of the recording medium being conveyed.

Embodiment 1

(Description of Process Cartridge and Image Forming Apparatus Main Assembly)

Figure 1:
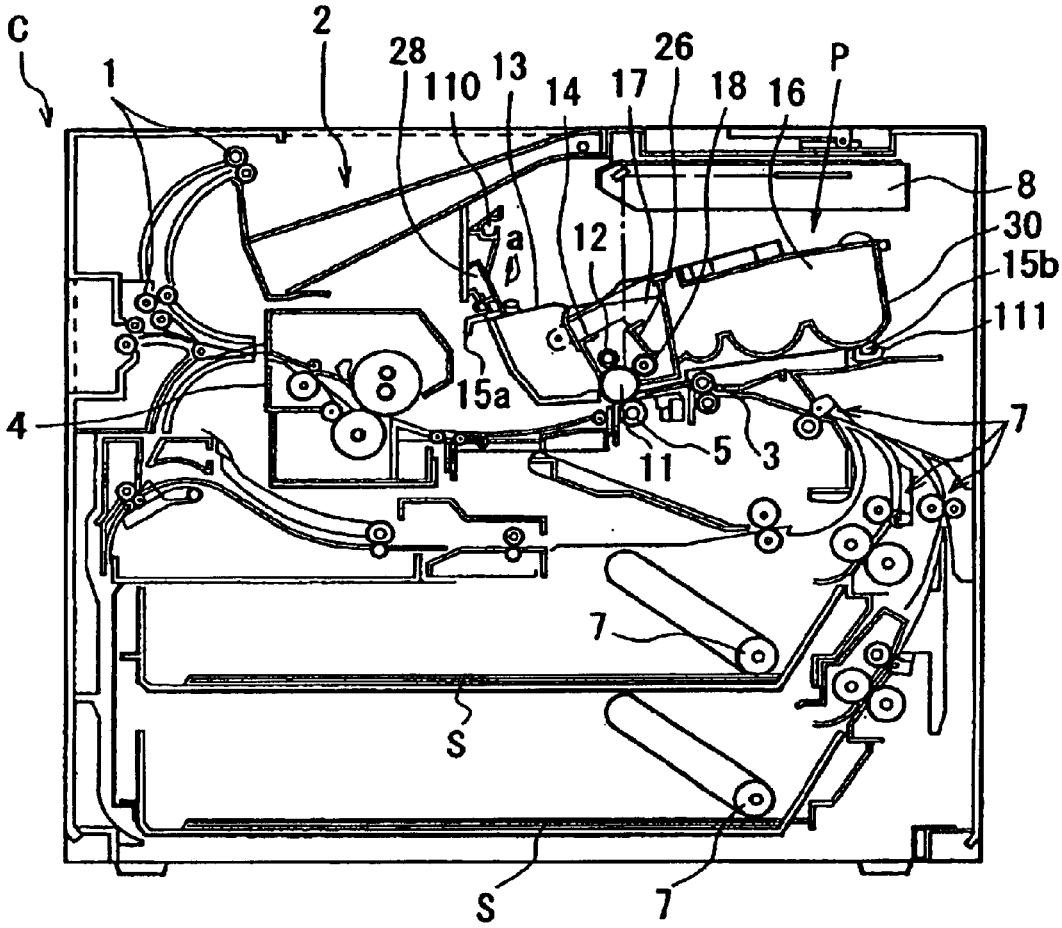
FIG. 1 is a longitudinal sectional view of an electrophotographic image forming apparatus.
Figure 2:
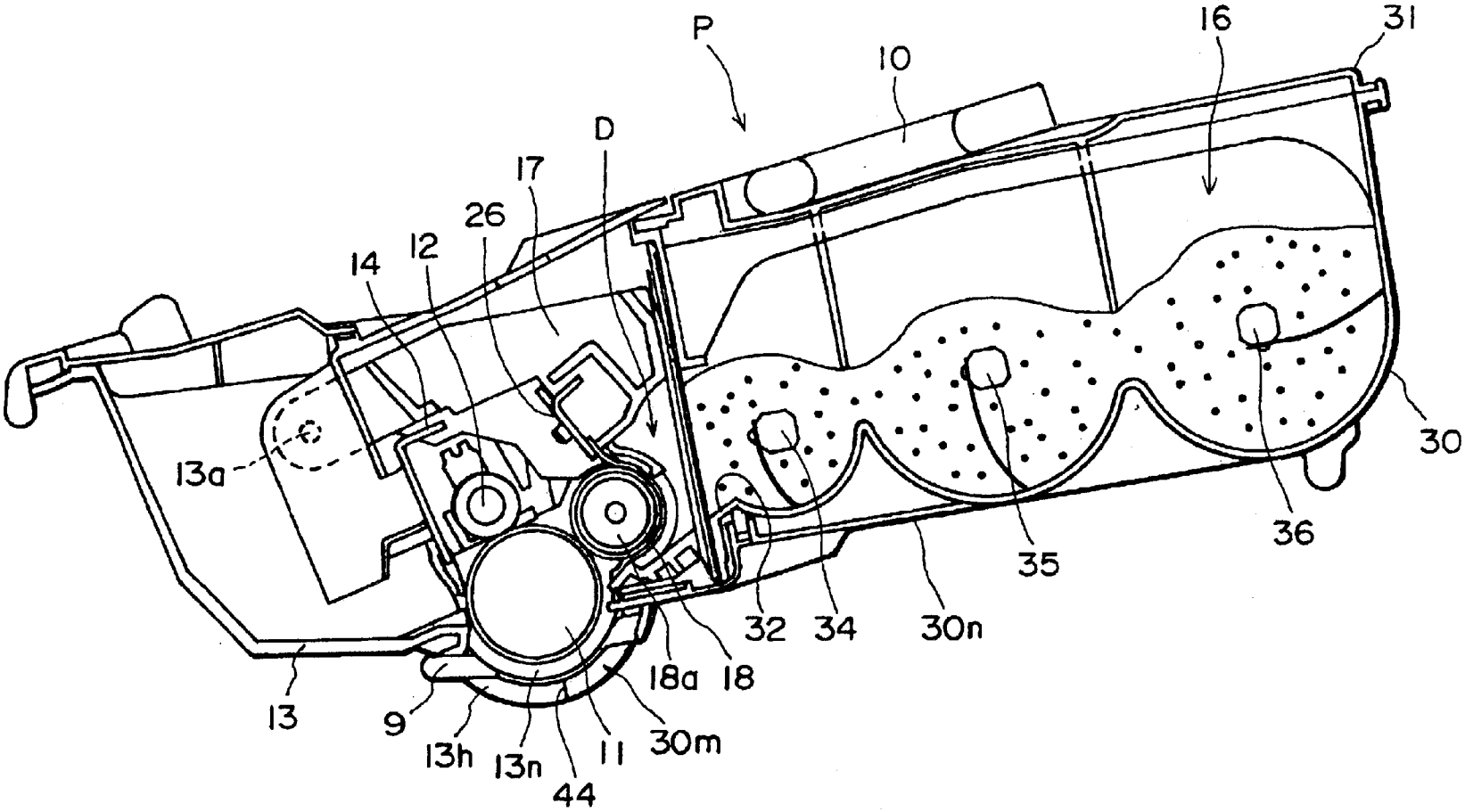
FIG. 2 is a longitudinal sectional view of a process cartridge.

FIG. 1 shows the vertical section of a typical electrophotographic image forming apparatus, perpendicular to the lengthwise direction, and FIG. 2 shows the vertical section of a typical process cartridge, perpendicular to the lengthwise direction.

The process cartridge P in this embodiment is structured as shown in FIG. 2. In other words, the process cartridge P comprises: a drum holding frame, which hereinafter will be called cleaning frame 13, in which a charge roller 12 as a charging means, and a cleaning blade 14 as a cleaning means, are disposed around an electrophotographic photoconductive drum 11; a developing means holding frame, as a developing apparatus D, which supports a development roller 18 and development blade 26; a toner storage container in which stirring members 34, 35, and 36 for stirring the toner are provided, and to which a toner storage lid 31 is welded.

A drum protection shutter 9 for protecting the photoconductive drum 11 is supported by the drum holding frame 13. These frames and the shutter are integrated into the form of a cartridge P, which can be mounted into or dismounted from, the image forming apparatus main assembly C, without subjecting the processing means to an undue amount of force, by grasping a handle 10 provided on the top surface of the toner storage lid 31.

The shutter 9 takes a closed position at which it completely covers the transfer opening 13*n*, or an open position at which it fully exposes the transfer opening 13*n*. More specifically, as the cartridge P is moved out of the apparatus main assembly C, it moves from the open position to the closed position, preventing the photoconductive drum 11 from being physically damaged, or from being exposed to external light, and as the cartridge P is mounted into the apparatus main assembly C, it moves from the closed position to the opening position, exposing the transfer opening 13*n*, and allowing the photoconductive drum 11 to directly oppose a transfer roller 5. The transfer opening 13n is narrow and long, and its dimension in terms of the lengthwise direction of the photoconductive drum 11 exceeds the image formation range in terms of the lengthwise direction of the photoconductive drum 11. The dimension of the transfer opening 13*n* in terms of the direction perpendicular to the lengthwise direction of the photoconductive drum 11 is greater than the diameter of the photoconductive drum 11. The transfer opening 13*n* is located between the drum holding frame 13 and developing means holding frame 17. In terms of the lengthwise direction, the position of one of the edges of the transfer opening 13*n* coincides with the position of the inward surface of the bearing cover portion 13*h* extending downward from the cleaning frame 13, whereas the position of the other edge coincides with the position of the inward surface of the bearing cover portion 30*m* extending downward from the bottom cover 30*n* attached to the developer container 30. The bearing cover portions 13*h* and 30*m* are connected to each other at a joint 44, forming an arcuate portion, the center of which virtually coincides with the axial line of the photoconductive drum 11. The peripheral surface of the photoconductive drum 11 is exposed through this transfer opening 13*n*.

As described above, the positions of the short edges, that is, the edges at the lengthwise ends, of the transfer opening 13*n* coincide with those of the inward surfaces of the bearing cover portions 13*h* and 30*m*.

The cartridge P is mounted in an image forming apparatus such as the one shown in FIG. 1, to be used for image formation.

The photoconductive drum 11 is charged by the charge roller 12, and selectively exposed by an exposing apparatus 8, in accordance with the image formation data As a result, an electrostatic latent image is formed. The exposing operation by the exposing apparatus 8 is carried out in synchronism with the conveyance of the sheet S by a registration roller pair 3.

Meanwhile, the toner in the toner storage unit 16 is conveyed to the development means holding frame 17, in which it is borne in a thin layer on the peripheral surface of the development roller 18 by the development blade 26. Then, development bias is applied to the development roller 18 so that the toner is supplied to the latent image on the peripheral surface of the photoconductive drum 11. As a result, a toner image is formed on the peripheral surface of the photoconductive drum 11. This toner image is transferred onto the aforementioned sheet S, which is being conveyed through the transfer station after having been conveyed thereto by the conveying rollers 7, by the application of bias voltage to the transfer roller 5. Then, the sheet S is conveyed to a fixing apparatus 4, in which the toner image is fixed to the sheet S. Then, the sheet S is discharged into a delivery portion 2 on top of the apparatus main assembly, by sheet discharge rollers 1. Meanwhile, the residual toner, that is, the developer remaining on the peripheral surface of the photoconductive drum 1, is removed by the cleaning blade 14, and is collected into the drum holding frame 13.

(Structure of Process Cartridge Frame)

Next, the developing apparatus and its adjacencies will be described further in detail.

Figure 3:
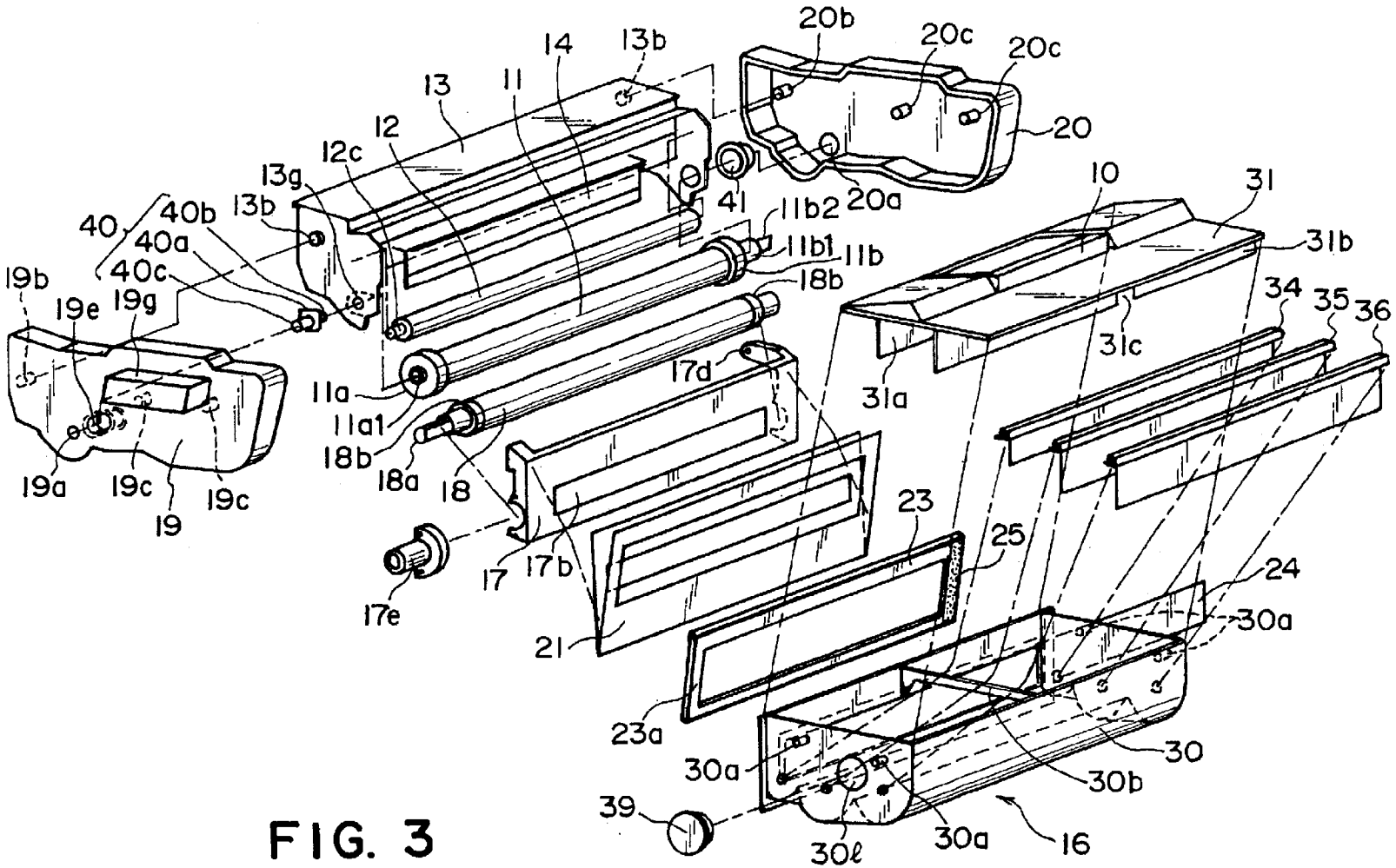
FIG. 3 is an exploded perspective view of a process cartridge.

FIG. 2 and 3 shows the structure of the cartridge P in this embodiment. The developing apparatus D of the cartridge P places the toner from the toner storage unit 16 onto the peripheral surface of the development roller 18, and then, supplies the toner on the peripheral surface of the development roller 18 to the peripheral surface of the photoconductive drum 11, in accordance with the latent image on the peripheral surface of the photoconductive drum 1, by applying development bias to the development roller 18.

The development roller 18 is cylindrical, and is formed of a metallic material such as aluminum or stainless steel. It contains a magnetic roller 18*a*.

FIG. 3 is an exploded perspective view of the cartridge P, for showing the components and structure of the cartridge P. The positional relationships between the toner storage unit 16 and side covers 19 and 20 become accurately fixed as the positioning joggles 30*a*, protruding from the outward surfaces of the side walls, in terms of the lengthwise direction, of the developer holding frame 30, are inserted into the center holes of the bosses 19*c* and 20*c* of the end covers 19 and 20, respectively. The cleaning frame 13 rotationally supports the drum 11, with the interposition of a bearing 41 and a drum shaft 40 located at the lengthwise ends, one for one. The positioning joggles 19*b* and 20*b* are fitted into the center holes of the positioning bosses 13*b*, one for one. As a result, the cleaning frame 13 becomes fixed to the end covers 19 and 20 as is the toner storage unit 16.

In other words, the frame 13 and unit 16 are held together by the end covers 19 and 20. The shaft 40 is provided with a flange portion 40*a*, a first shaft portion 40*b*, and a second shaft portion 40*c*. The flange portion 40*a* is the portion by which the shaft 40 is attached to the frame 13, and the first shaft portion 40*b* is the portion to be inserted into the center hole of the flange 11*a* of the drum 11. The second shaft portion 40*c* perpendicularly protrudes from the outward surface of the flange portion 40*a* (therefore, in the direction opposite to the direction in which the first shaft portion 40*b* protrudes), and is long enough to project outwardly through the hole 19*a* of the end cover 19. The aforementioned flange 11*a* is guided by a U-shaped groove 13*g* (contoured by a dotted line in FIG. 3, and contoured by a solid line in FIG. 17) in the inward surface of the frame 13, when the drum 11 is mounted in the frame 13. Further, the flange 11*a* has a guide portion 11*al* for temporarily keeping the drum 11 accurately positioned relative to the frame 13 until the attachment of the shaft 40. This guide portion 11*a*1 is cylindrical, and is smaller in diameter than the portion of the flange 11*a*, from the outward surface from which it perpendicularly projects. Its axial line coincides with that of the drum 11.

Referring to FIGS. 2 and 3, the developing means holding frame 17 of the developing apparatus D supports developing members such as the development roller 18, the development blade 12, and the like. It is connected to the frame 13, with the pins inserted in the holes 13*a* (FIG. 6) of the frame 13 and the holes 17*d* of the developing means holding frame 17, being enabled to pivot about the axial line of the holes 17*d* (13*a*). Here, referring to FIG. 6, which shows one of the lengthwise ends of the cartridge P, with the end cover 20 removed, a tension coil spring 22 is stretched between the frame 13 and frame 17, being attached to the spring anchoring portions 13*c* and 17*f* projecting from the frames 13 and 17, respectively.

Figure 6:
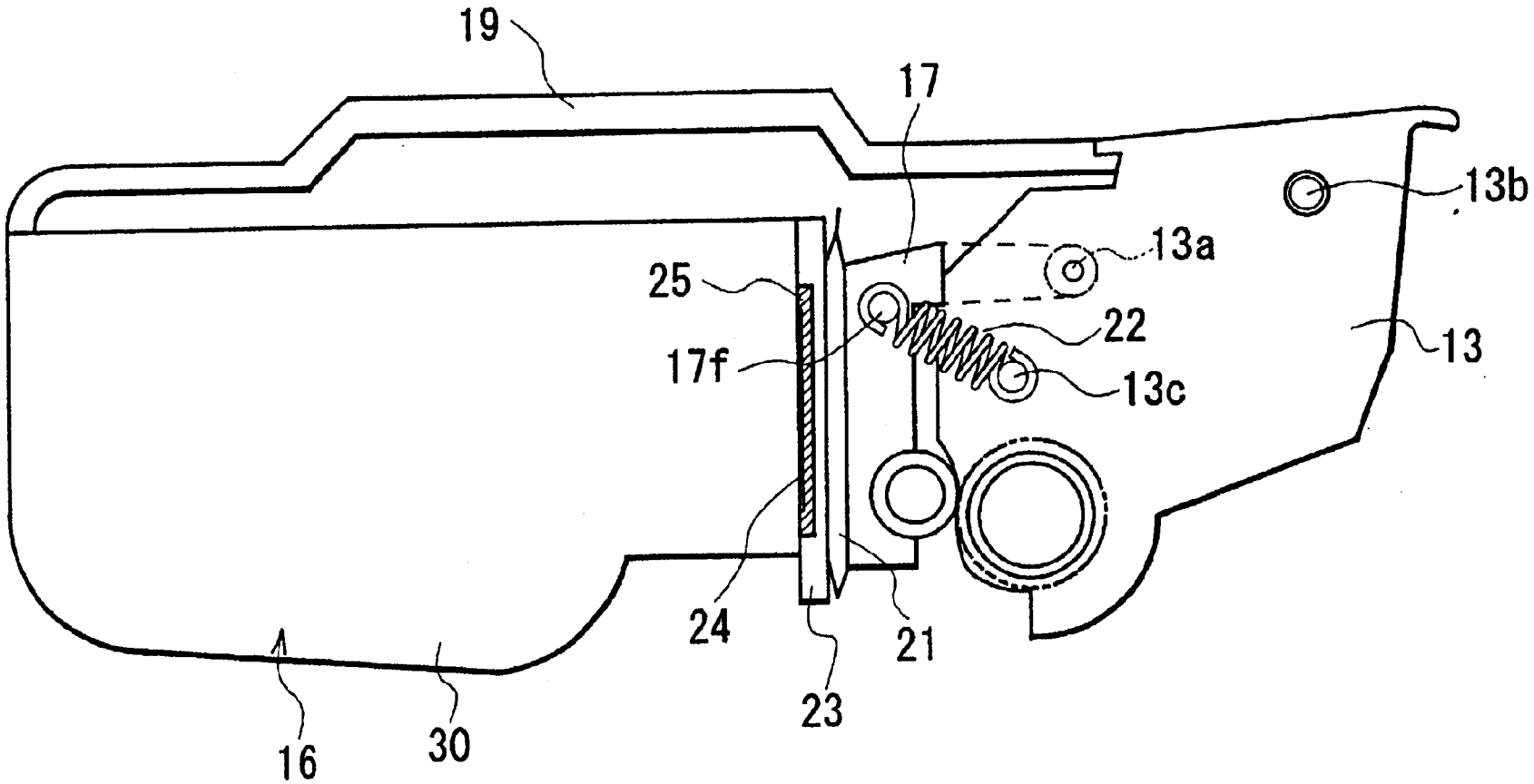
FIG. 6 is a rear view of a process cartridge with a side cover omitted.
Figure 7:
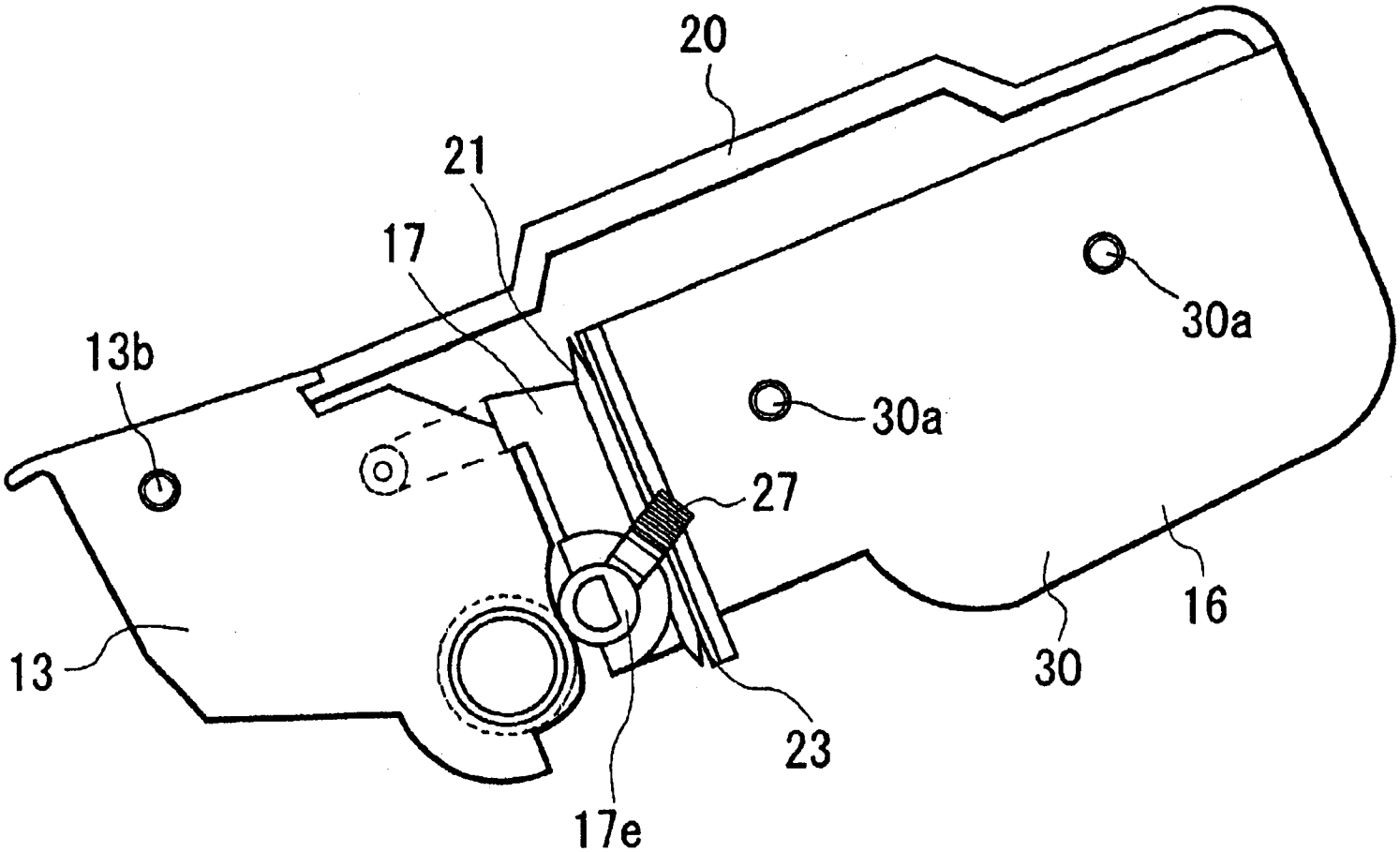
FIG. 7 is a front view of a process cartridge with a side cover omitted.

Next, referring to FIG. 3, and FIG. 7 which shows the lengthwise end of the cartridge opposite to the end shown in FIG. 6, a compression coil spring 27 is fitted in a groove 19*e* of the cover 19, being compressed so that it presses the development roller bearing 17*e*, which is secured to the lengthwise end of the frame 17, rotationally supporting one of the lengthwise ends of the development roller 18. With the presence of the force from the spring 22, a pair of spacer rings 18*b*, which are greater in radius by an amount equivalent to the development gap (approximately 300 $\mu$m) than the photoconductive drum 11 and are concentrically fitted around the lengthwise end portions of the development roller 18, are kept pressed upon the peripheral surface of the photoconductive drum 11, outside the image formation range. With the provision of this structural arrangement, a gap is provided between the developing means holding frame 17 and developer holding frame 13.

In this embodiment, the gap between the developing apparatus D and developer holding frame 30 is sealed with a sealing member, which is made by folding and pasting a jointing sheet 21 attached to the developer holding frame 30 with the interposition of a jointing plate 23. The jointing sheet 21 in this embodiment is no more than 1 mm in thickness. However, the jointing sheet thickness may be more than 1 mm, provided that the substance selected as the material for the jointing sheet 21 is such that even if it is made into a jointing sheet thicker than 1 mm, it does not prevent the bellows-like jointing member, into which the jointing sheet is fold, from remaining flexible.

Figure 12:
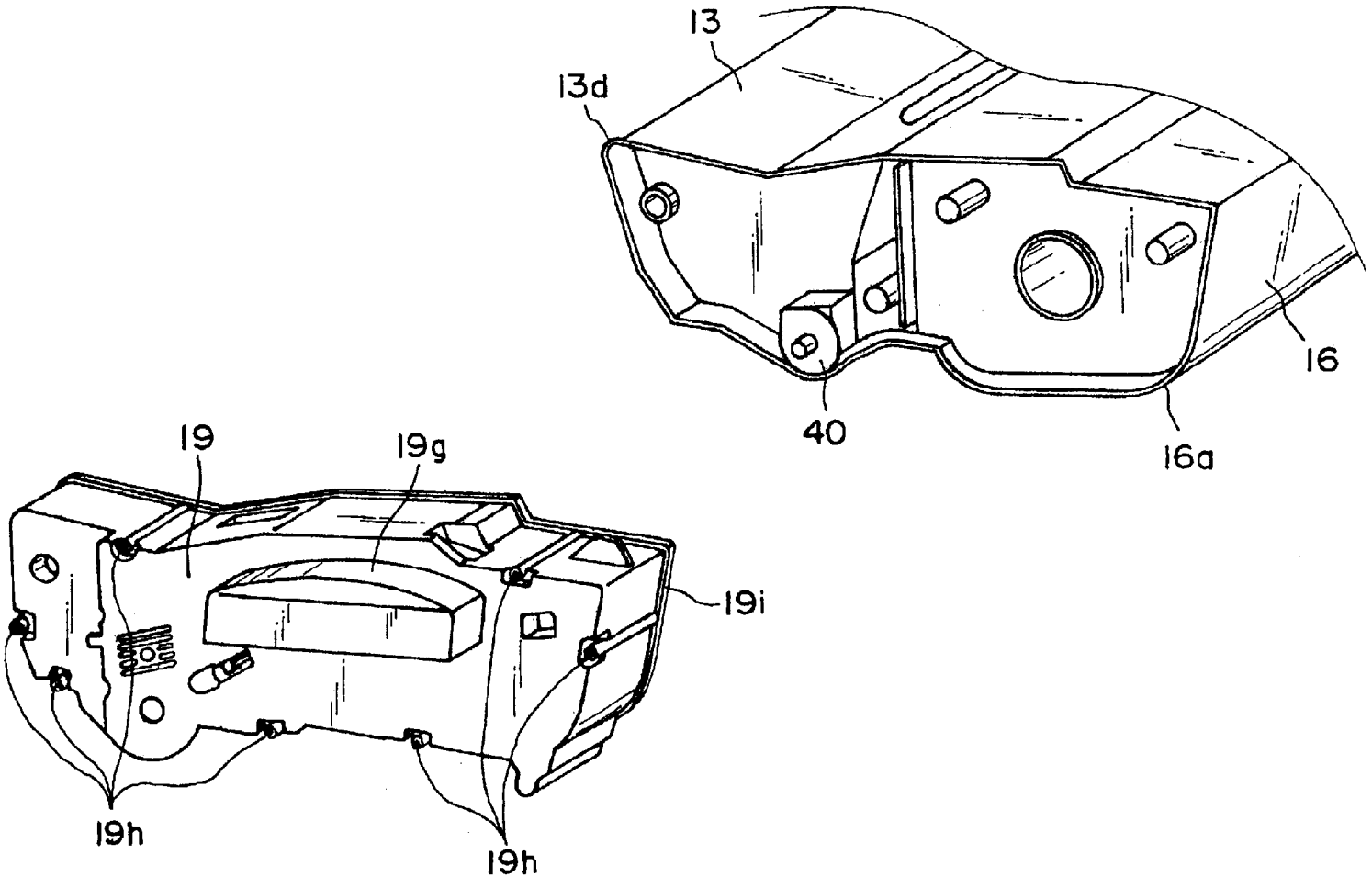
FIG. 12 is a perspective view illustrating a connecting method of a side cover for the process cartridge.

Referring to FIG. 12, the outward edge 13*d* of the cleaning frame 13, the outward edge 16*a* of the toner storage unit 16, and inward edge 19*i* of the cover 19, are structured so that as the combination of the drum holding frame 13 and toner storage unit 16 is joined with the cover 19, a groove (unshown) is formed, into which melted resin flows through the gate 19*h* of the cover 19. As melted resin flows into this groove, the frame 13, the unit 16, and the cover 19 are solidly secured to each other. Then, the cover 20 is also joined with the combination of the frame 13 and unit 16, in the same manner as is the cover 19, completing the cartridge P.

Figure 16:
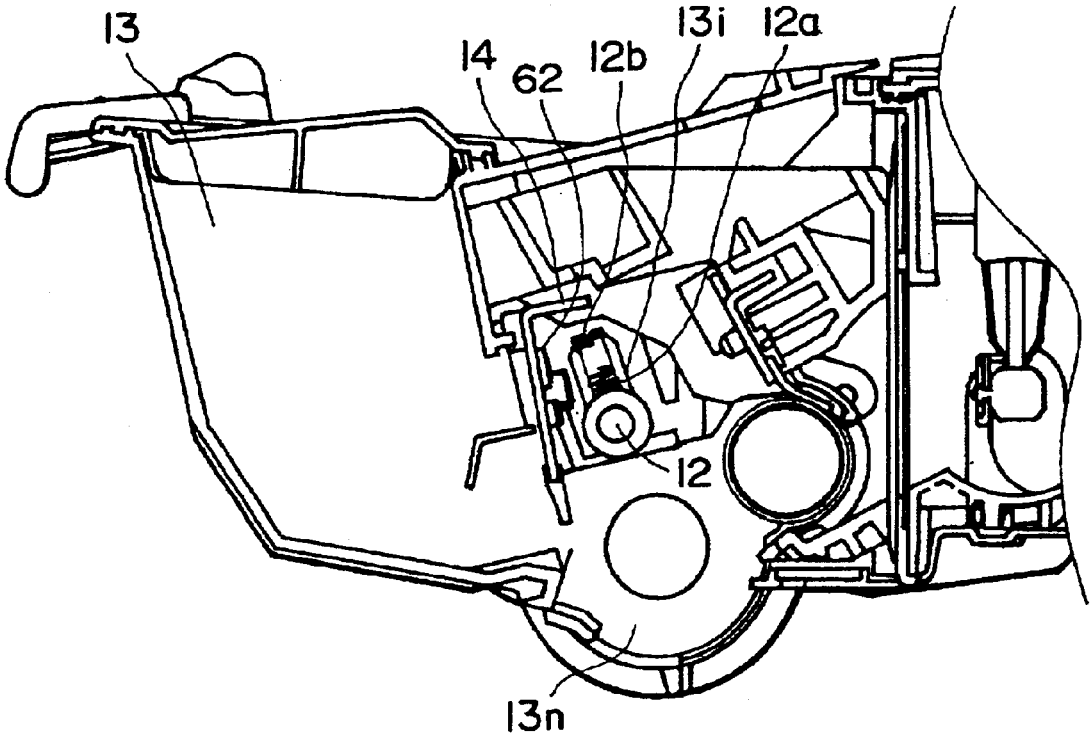
FIG. 16 is a sectional front view of a cleaning frame and a developing device, illustrating a remanufacturing method for a process cartridge.

The charge roller 12 comprises a metallic core 12*c*, and a cylindrical rubber layer (FIG. 3) fitted around the metallic core 12*c*. The electrical resistance of the rubber layer is in the mid range. Referring to FIG. 16, the frame 13 is provided with a guide-way 13*i*, which extends in the lengthwise direction of the frame 13 parallel to the axial line of the photoconductive drum 11, and astride the axial line of the photoconductive drum 11, in terms of the direction perpendicular to the lengthwise direction of the photoconductive drum 11. In this guide-way 13*i*, a charge roller bearing 12*a* is slidably fitted. In this bearing 12*a*, the metallic core 12*c* of the charge roller 12 is rotationally fitted. At the rear end of the cartridge P, a compression coil spring 12*b* is disposed between the guide-way 13*i* and bearing 12*a*. The spring 12*b* is fitted around a projection of the charge roller bearing 12*a*, with the anchoring portion of the spring 12*b* tightly fitted around the base portion of the projection, facilitating the process cartridge assembly. With this structural arrangement, the charge roller 12 is kept pressed upon the drum 11, by the pressure applied to the charge roller 12 by the resiliency of the spring 12*b* through the bearing 12*b*. Incidentally, the charge roller 12 is rotated by the rotation of the photoconductive drum 11.

(Method for Forming Pouch-like Sealing Member)

Figure 4:
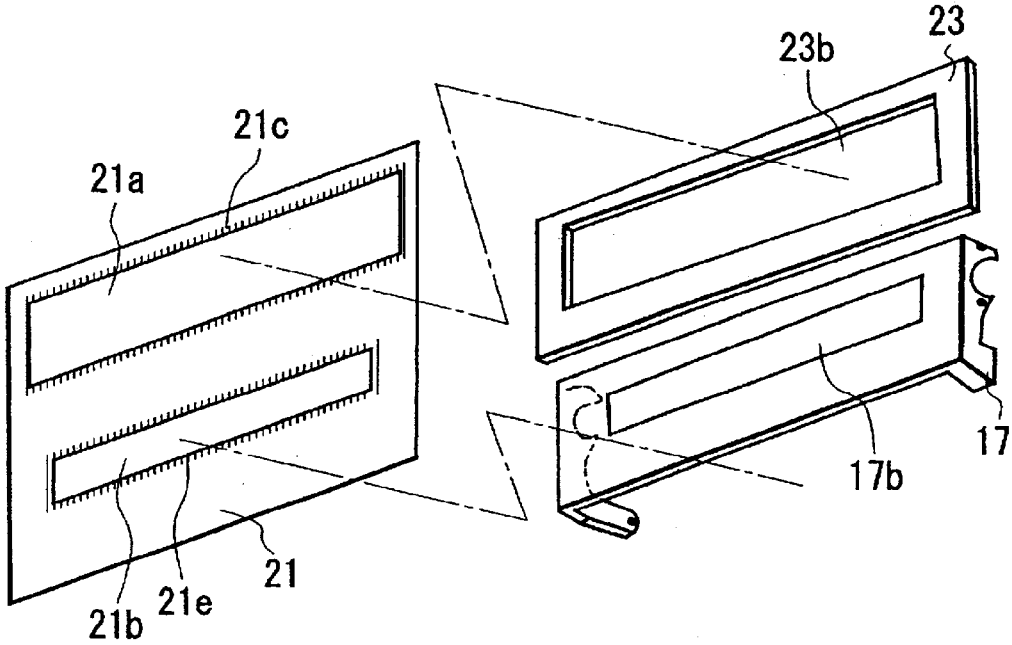
FIG. 4 is a perspective view illustrating a forming method for a sealing member for a process cartridge.
Figure 5:
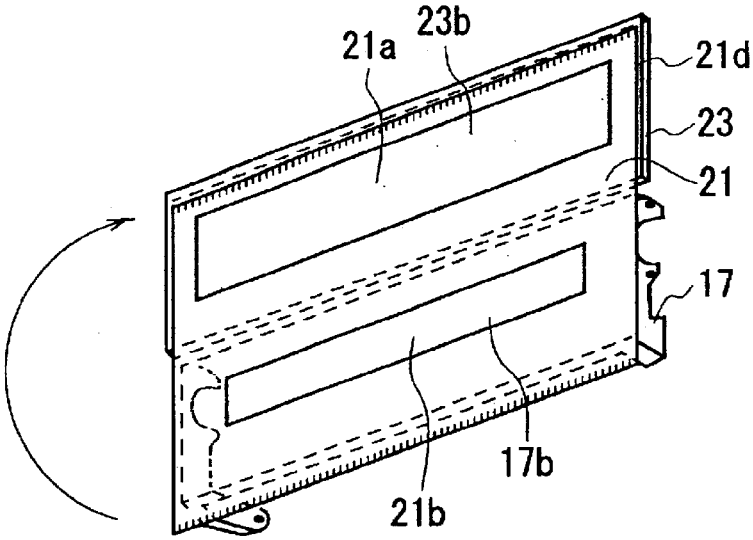
FIG. 5 is a perspective view illustrating a forming method for a sealing member for a process cartridge.

Next, referring to FIGS. 4 and 5, a method for forming the pouch-like sealing member from the jointing sheet 21 is roughly described. Referring to FIG. 4, the jointing sheet 21 is provided with holes 21 a and 21*b*, the sizes of which are approximately the same as, or greater than, those of the holes 23*b* and 17*b* of the jointing plate 23 and developing means holding frame 17, respectively. The jointing sheet 21 is attached to the edges of the holes 23*b* and 17*b* of the jointing plate 23 and developing means holding frame 17, by the edge portions 21*c* and 21*e* of the holes.

In this embodiment, the jointing sheet 21 is attached to the developing means holding frame 17 and jointing plate 23 by a thermal welding method, such as a thermal sealing method or an impulse sealing method. However, ultrasonic welding, an adhesive, adhesive tape, or the like methods, may be used.

After being attached to the developing means holding frame 17 and the jointing plate 23, the jointing sheet 21 is folded in the direction indicated by an arrow mark, as shown in FIG. 5, so that the holes 21*a* and 21*b* squarely face each other (holes 23*b* and 17*b* squarely face each other). Then, the two sections of the jointing sheet 21 created by the folding are attached to each other, by the entirety of the edge portion 21*d*, creating a bellows-like (pouch-like) member. The means for attaching the above described two sections of the jointing sheet 21 may also be a thermal welding method, such as a heat sealing method, or an impulse sealing method, an ultrasonic welding, an adhesive, adhesive tape, or the like.

Next, the jointing plate 23 is attached to the developer container 30, leaving a portion partially unwelded or unpasted to provide a gap through which a toner seal 24 can be passed. In this embodiment, the portion 23*a* is welded or pasted to the surface 30*h* (FIG. 10) of the developer container 30 provided with a hole 32 as a toner delivery hole, except for the area across which the toner seal 24 is kept pressed by a toner sealing member 25 (FIG. 3).

The provision of the above described structural arrangement, in other words, the placement of a pouch-like bellows formed of the jointing sheet 21 between the mutually facing surfaces of the container 30 and frame 17, minimizes the resistance which occurs as the distance between the mutually facing surfaces of the frame 30 and frame 17 varies. Further, the placement of the jointing sheet 21 between the jointing plate 23 and developing means holding frame 17 makes it possible to attach the jointing plate 23 in a manner to cover the toner seal 24. With the provision of this arrangement, the toner sealing member 25 can be placed in the gap through which the toner seal 24 is passed, preventing toner leak (FIG. 6).

The provision of the jointing plate 23 makes simpler the configuration of the welding table necessary for welding the jointing sheet 21 to the mutually facing surfaces of the frame 17 and jointing plate 23, compared to that necessary in the absence of the jointing plate 23, that is, when the jointing sheet 21 has to be directly pasted to the frame 30.

Further, the provision of the jointing plate 23 makes it possible to assemble the developing means holding frame 17, the jointing plate 23, and the jointing sheet 21 into a unit which can be easily attached to the container 30. The frame 17 and unit 16 jointed together into a development unit.

(Mounting or Dismounting of Process Cartridge into or out of Apparatus Main Assembly)

FIG. 1 is a sectional view of an image forming apparatus, in which the cartridge P is ready for image formation. In order to dismount the cartridge P in the state shown in FIG. 2, a lever (unshown) located on the front wall of the apparatus main assembly C is to be rotated. As the lever is rotated, an arm 28 is rotated in the direction indicated by an arrow mark (a). As a result, the left side of the cartridge P, with reference to the drawing, is raised by a part (unshown) of the arm 28. As the left side of the cartridge P is raised, the cartridge P rotates, while being raised, about the guide portions or fulcrum 15*b* rested on the guide rails 111 of the apparatus main assembly C, until the guide portions 15*a*, with which only the back side of the cartridge P is provided, aligns with the guide rails 110 of the apparatus main assembly C. In this state, the cartridge P is to be pulled toward the front side of the apparatus main assembly C, in the direction perpendicular to the plane of the FIG. 1. As the cartridge P is pulled, the guide portions 15*a* transfer onto the guide rails 110, and the cartridge P becomes disengaged from the arm 28. Then, the cartridge P can be pulled straight out of the apparatus main assembly C.

The procedure for mounting the cartridge P into the apparatus main assembly C is reverse to the above described dismounting procedure. In other words, the cartridge is to be inserted into the apparatus main assembly C, with the guide portion 15*a* and fulcrum 15*b* aligned with the rails 110 and 111, in the direction perpendicular to the plane of the FIG. 1. As the cartridge is inserted inward of the apparatus main assembly C, the top left portion of the cartridge P is caught by the arm 28 before the guide portion 15*a* becomes disengaged from the rail 110. Then, as the cartridge P is pushed further into the apparatus main assembly C, the guide portion 15*a* disengages from the rail 110. Then, a lock (unshown) of the arm 28 is to be disengaged, and the aforementioned lever (unshown) on the front side of the apparatus main assembly C is to be rotated to rotate the arm 28 in the direction opposite to the direction indicated by the arrow mark (a). The rotation of the arm 28 is assisted by the weight of the cartridge P itself.

As the cartridge P approaches the position at which the cartridge can form an image, the second shaft portion 40*c* of the drum shaft 40 (FIGS. 3) protruding outward of the cover 19, through the aforementioned hole 19*a* of the cover 19, shown in FIG. 3, fits into the drum shaft positioning recess (unshown) of the apparatus main assembly C, being therefore accurately positioned (drum bearing 41 on the cover 20 side protrudes outward through the hole 20*a* of the cover 20). As a result, the cartridge P is accurately positioned relative to the apparatus main assembly C, and therefore, the photoconductive drum 11 is accurately positioned relative to the apparatus main assembly C, because the axial lines of the photoconductive drum 11, the drum bearing 41, and the drum shaft 40 coincide.

The side wall of the cover 19, which surrounds the second shaft portion 40*c*, makes contact with the inward surface of the portion of apparatus main assembly C with the recess (unshown) in which the shaft portion 40*c* fits. As a result, the position of the cartridge P relative to the apparatus main assembly C in terms of the lengthwise direction is accurately fixed. With the provision of the above described structural arrangement, even a process cartridge (P), which is heavy because of a large amount of toner contained in the developer container 30, can be smoothly mounted into, or dismounted from, the apparatus main assembly C. Incidentally, the cartridge P is also provided with a handle 19*g* (FIG. 12), in addition to the handle 10 on the top surface. The handle 19*g* is attached to the second cover 19, being on the front side in terms of the direction in which the cartridge P is mounted or dismounted. The provision of the additional handle 19*g* makes it easier to carry the cartridge P, and also to handle the cartridge P at the beginning of the mounting of the cartridge P or the end of the dismounting of the cartridge P. The flange 11*b* of the drum 11, on the driven side, comprises a journal portion 11*b*1, which is rotationally supported by the bearing 41, and a driving force receiving portion 11*b*2, which projects from the journal portion 11*b*1. The driving force receiving portion 11*b*2 is in the form of a triangular pillar which is twisted about its axial line, and has a cross section in the form of an equilateral triangle. It is driven by the driving shaft on the apparatus main assembly C side, being fitted into the twisted triangular hole (unshown) of the driving shaft.

(Description of Toner Storage Unit)

Figure 8:
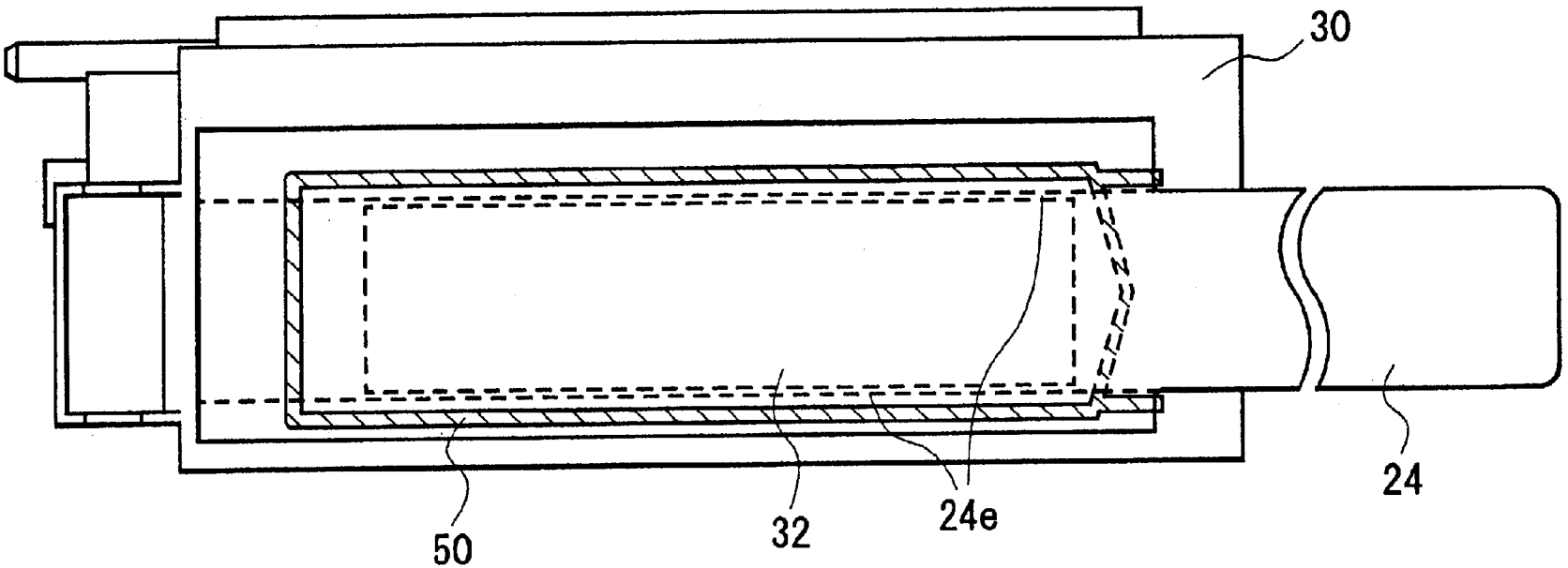
FIG. 8 is a front view of a toner seal for a toner accommodating container.

Next, referring to FIGS. 8, 9, 10, and 11, the unit 16 will be described. The unit 16 comprises the container 30, toner storage lid 31, and stirring members 34, 35, and 36. Referring to FIG. 8, the container 30 is provided with the developer delivery hole 32 through which the toner is sent out to the developing means holding frame 17. The hole 32 is covered with the seal 24, which is thermally welded to the unit 16, along the surrounding edge of the hole 32 (FIG. 8). A reference numeral 50 denotes the welded portion (hatched portion).

Figure 9:
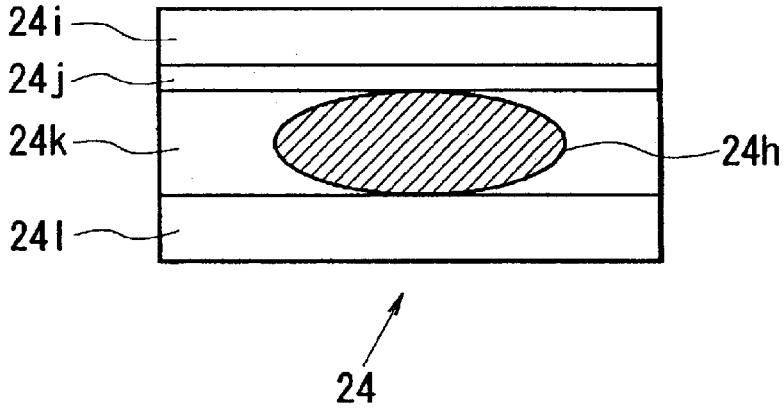
FIG. 9 is a sectional view illustrating a layer structure of a toner seal member.

The toner seal 24 in this embodiment has a laminar structure, having:

- a 12 μm thick polyester layer (strength providing layer: 24*i* in FIG. 9),
- a 7 μm thick aluminum foil layer (laser beam blocking layer: 24*j* in FIG. 9),
- a 50 μm thick polyester layer (tear guiding layer: 24*k* in FIG. 9), and
- a 50 μm thick sealant layer (adhesive layer: 24*l* (el) in FIG. 9), listing from the top layer.

Tear lines 24*e* of the seal 24, along which the seal 24 is torn open, have been subjected to a laser-cut process for creating gaps in the tear guiding layer, along the tear lines 24*e*. FIG. 9 is a sectional view of the seal 24. The seal 24 has a gap 24*h* created by a laser. The provision of the aluminum foil layer 24*j*, which blocks a laser beam, prevents the top polyester layer, or the strength providing layer 24*i*, from being damaged by the laser beam, assuring satisfactory sealing performance. The provision of the aluminum foil layer also causes the stress to concentrate at the gap 24*h* when the seal 24 is pulled to be opened, ensuring that the seal 24 is torn along the tear lines 24*e*.

Figure 10:
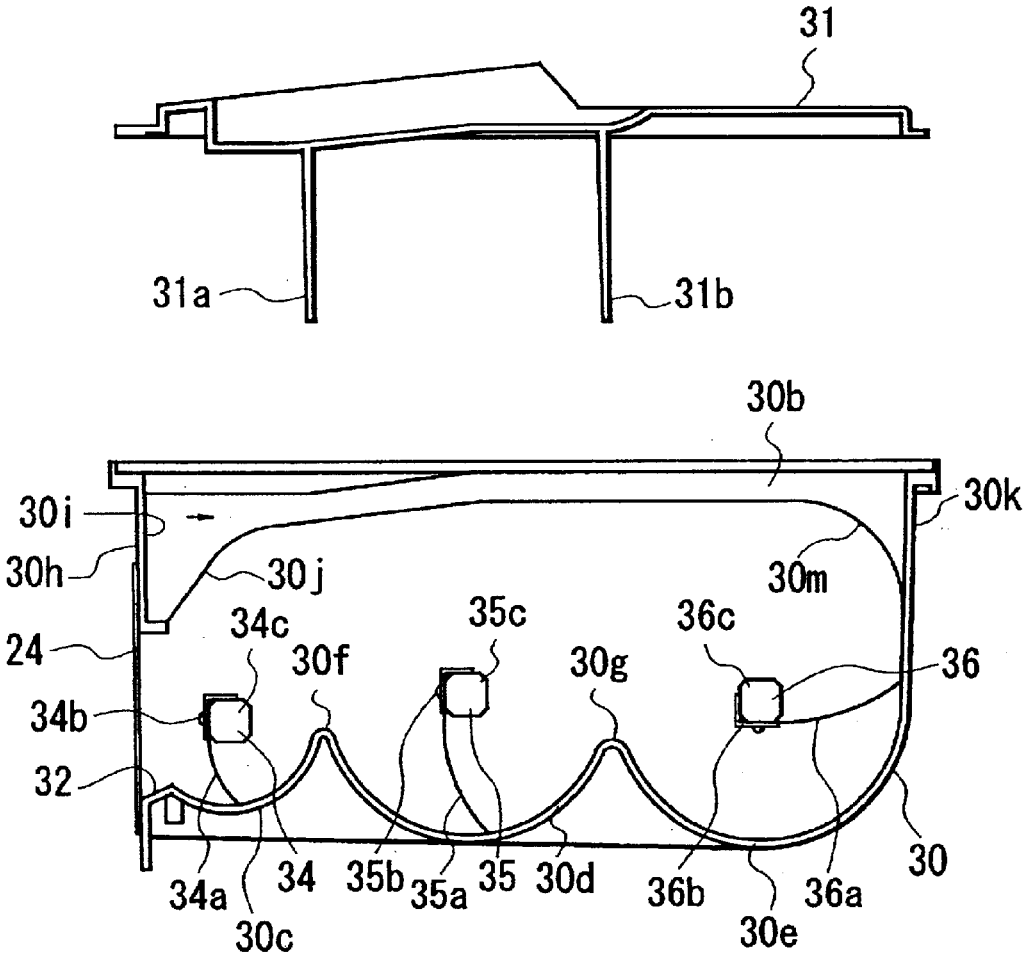
FIG. 10 is a sectional front view of a toner accommodating container before welding.
Figure 11:
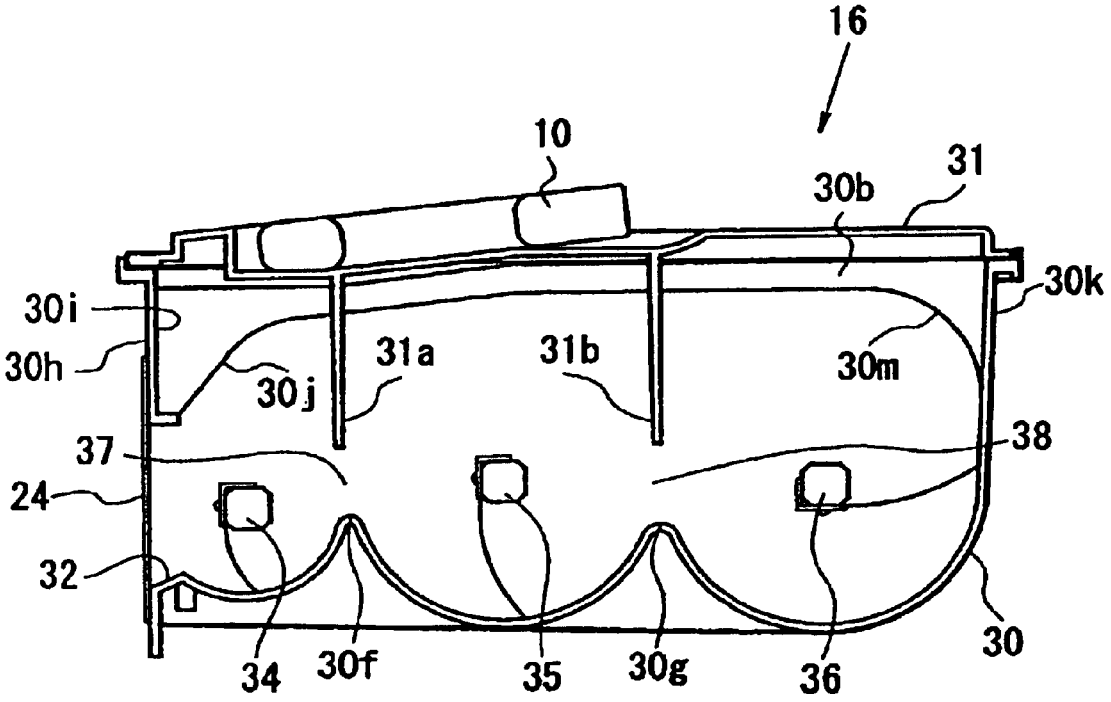
FIG. 11 is a sectional front view of a toner accommodating container after welding.

Referring to FIG. 10, within the container 30, the stirring members 34, 35, and 36 are provided, which send the toner to the developing means holding frame 17 through the toner delivery hole 32, while stirring the toner. The stirring members 34, 35, and 36 comprise: shaft 34*c*, 35*c*, and 36*c*; stirring blades 34*a*, 35*a*, and 36*a*; and blade holders 34*b*, 35*b*, and 36*b*, by which the stirring blades 34*a*, 35*a*, and 36*a*, are held to the shafts 34*c*, 35*c*, and 36*c*, respectively. In this embodiment, the blade 34*a* is formed of a 50 μm thick PPS sheet, and blades 35*a* and 36*a* are formed of an approximately 100 μm thick PPS sheet. The stirring members 34, 35, and 36 all rotate in the same direction (clockwise in FIG. 2). The stirring member 34, that is, the stirring member nearest to the developing means holding frame 17 rotates at approximately 20 rpm, and the other two stirring members 35 and 36 rotate at approximately 5 rpm.

The bottom wall of the container 30 is shaped so that its cross section looks as if it is made by connecting three semicircles: 30*c*, 30*d*, and 30*e*, the centers of which coincide with the axial lines of the shafts 34*c*, 35*c*, and 36*c*, respectively. The distances from the axial lines of the shafts 34*c*, 35*c*, and 36*c* to the tips of the blades 34*a*, 35*a*, and 36*a*, when the blades are straight, are made greater than the radii of the semicircular portions 30*c*, 30*d*, and 30*e*, respectively, making it possible for the blades 34*a*, 35*a*, and 36*a* to stir the toner while scraping the bottom wall of the container 30. Therefore, even after the remaining amount of the toner becomes small due to toner delivery, the blades can scrape the toner away from the bottom wall, and send the toner to the developing means holding frame 17, reducing the amount of the unusable toner, or the toner which fails to be delivered and remains in the developer holding container 30. In this embodiment, the distances the blades 34*a*, 35*a*, and 36*a* hypothetically invade into the semicircular portions 30*c*, 30*d*, and 30*e*, respectively, of the bottom wall, are 2–4 mm.

Within the container 30, a bridge-like rib 30*b* is provided, which extends from the internal surface 30*i* of the wall 30*h* to which the aforementioned jointing plate 23 is attached in a manner to cover the hole 32, to the rear wall 30*k*, in terms of the cartridge mounting direction, of the container 30. The bottom edge of the rib 30*b* is contoured so that it does not interfere with the installation of the stirring member 34 into the container 30, being slanted across the portion 30*j* near the edge of the hole 32, and being arcuate across the portion 30*m* next to the rear wall 30*k*.

The lid 31 is provided with isolation ribs 31*a* and 31*b*, which extend in the lengthwise direction of the cartridge. In terms of the direction perpendicular to the lengthwise direction of the cartridge, the positions of the isolation ribs 31*a* and 31*b* virtually coincide with the position of the joint 30*f* between the semicircular portions 30*c* and 30*d*, and the position of the joint 30*g* between the semicircular portions 30*d* and 30*e*, of the bottom wall of the container 30. In order for the ribs 31*a* and 31*b* not to interfere with the rib 30*b* within the developer container 30, the center portions 31*c* of the rib 31*a* and 31*b* have been cut out (FIG. 3). After the installation of the stirring members 34, 35, and 36 into the container 30, the lid 31 and container 30 are welded to each other by ultrasonic welding or vibration welding, completing the toner storage unit 16. The gaps 37 and 38 left between the ribs 31*a* and 31*b* and the protruding joints 30*f* and 30*g* are the gaps necessary for sending out the toner. In this embodiment, the gaps are approximately 10 mm–30 mm wide.

After assembling the unit 16 as described above, the container 30 is filled with the toner through the toner inlet 30*l* (el), and is sealed with a toner cap 39, completing the unit 16.

The inlet 30*l* (el) is provided as a filling opening at one of the lengthwise ends of the container 30.

(Embodiment 1 of Process Cartridge Remanufacturing Method in Accordance with Present Invention)

Next, a method for overhauling the cartridge P in this embodiment will be described.

Figure 13:
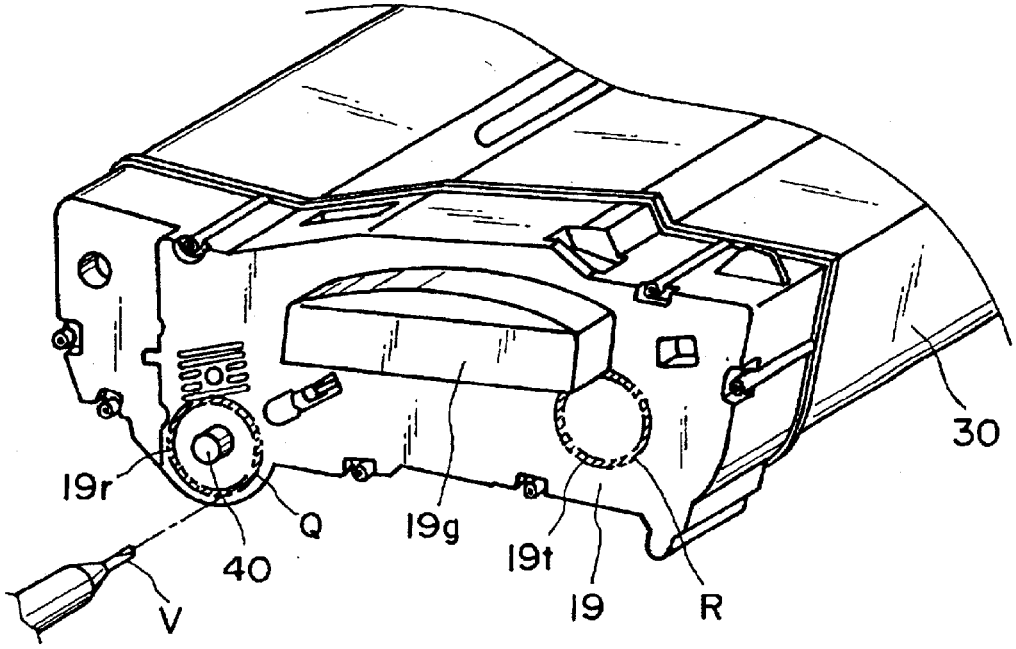
FIG. 13 is a perspective view around the side cover, illustrating a remanufacturing method of a process cartridge.

As shown in FIG. 13, the process cartridge P is fixed by a chuck of a milling machine. A peripheral portion of a drum supporting shaft 40 (hatched portion Q) projected out of the side cover 19 is cut off using an end mill V. In this embodiment, the milling cutter is used for the cutting, but another cutting tool can be used, such as an ultrasonic cutter, a heated blade, or another rotating cutter (a auger cutter having a hollow cylindrical end, for example). The portion cut out of the side cover 19 (the inside portion of the hatched portion Q) is pulled off the drum supporting shaft 40, by which the hole 19*r* is formed. In the similar manner, the portion of the side cover 19 corresponding to the toner filling opening 30*l* provided in the toner accommodating container 30 (hatched portion R) is cut off, by which a hole 19*t* is formed.

Figure 14:
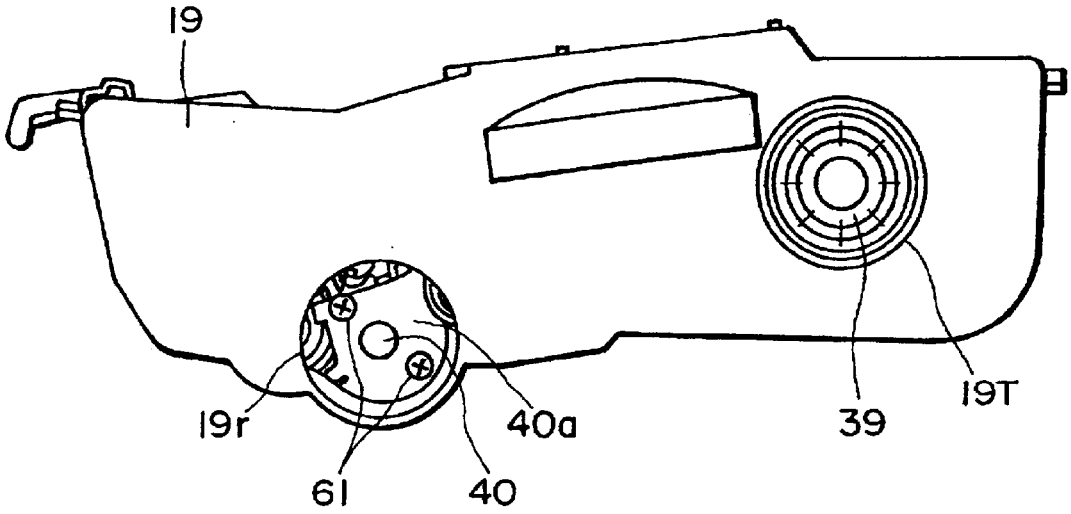
FIG. 14 is a front view illustrating a remanufacturing method of a process cartridge.
Figure 15:
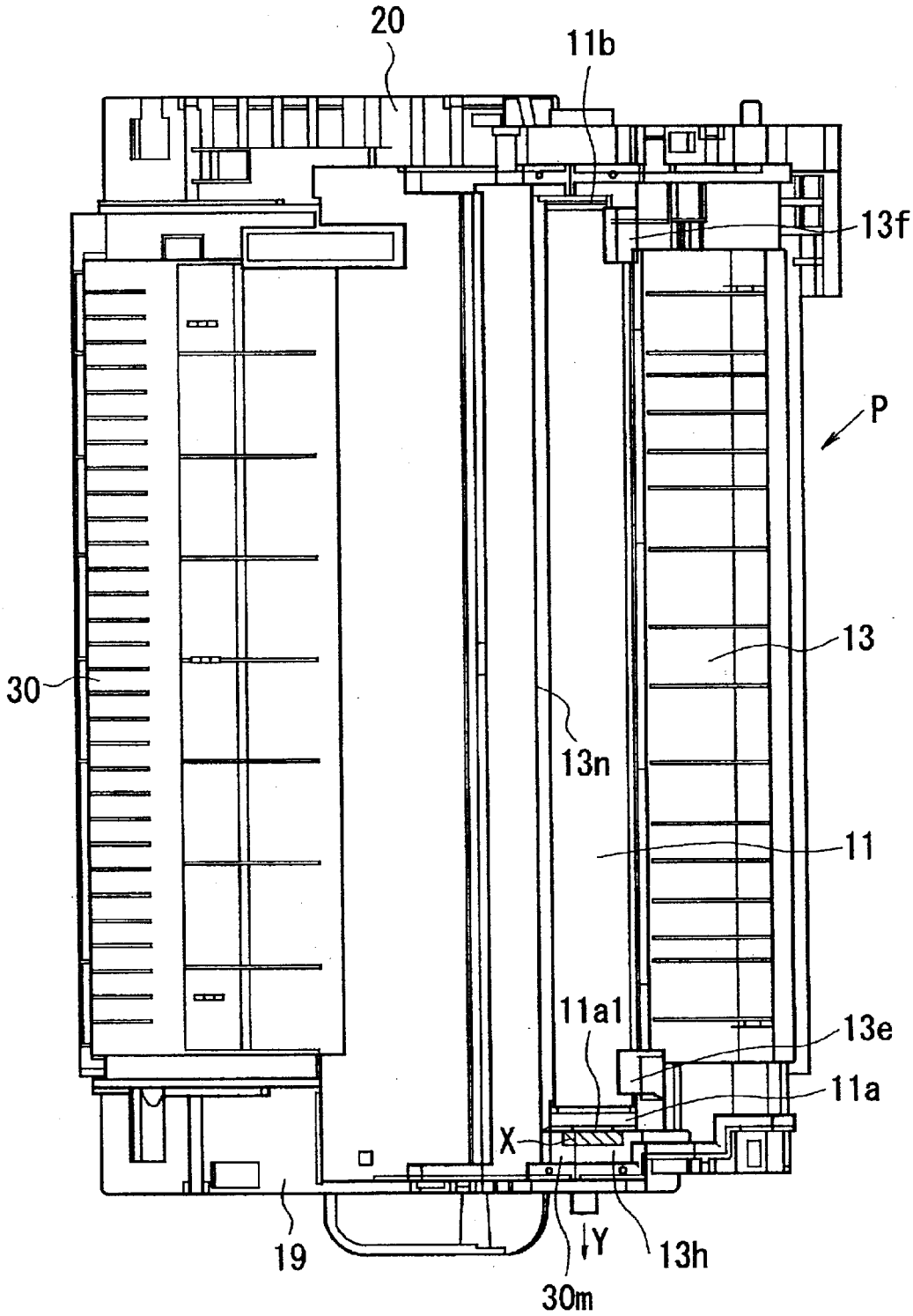
FIG. 15 is a bottom plan view of the process cartridge, illustrating a showing of a remanufacturing method.

Thereafter, a tool is inserted through the hole 19r shown in FIG. 14 to thread the small screws 61 fixing the flange portion 40*a* of the drum supporting shaft 40 to the cleaning frame 13. Then, the drum supporting shaft 40 is pulled out of the cleaning frame 13 through the hole 19*r*. FIG. 15 is a bottom view of the process cartridge P. In this figure, projected portions, 13*e*, 13*f*, extended integrally from the cleaning frame 13 adjacent the longitudinal end portion of the image transfer opening 13*n*, cover neighborhoods of the longitudinal ends of the photosensitive drum 11. Each of the surfaces of the projected portions 13*e*, 13f opposed to the photosensitive drum 11 are provided with a magnet (unshown) for collecting the toner, a small amount of which may scatter at the longitudinal end portions of the cleaning blade 14.

A guide portion 11*a*1 of a flange 11*a* provided at one end of the photosensitive drum 11 is covered by bearing cover portions 13*h*, 30*m* which is a frame defining a short side of the transfer opening 13*n*. In this embodiment, the projected portions 13*e*, 13*f* are cut off by a cutter, an ultrasonic cutter or another cutting tool to remove a part (indicated by hatching) of the frame covering the guide portion 11*a*1. Then, a flange 11*a* side of the photosensitive drum 11 is raised to incline the process cartridge, and the photosensitive drum 11 is pulled out through the transfer opening 13*n* in the direction indicated by an arrow Y. In this manner, the photosensitive drum 11 can be taken out of the process cartridge P. FIG. 16 illustrates the process cartridge P from which the photosensitive drum 11 has been removed.

Thereafter, as desired, the charging roller 12 and/or the cleaning blade 14 is removed.

In FIG. 16, the charging roller bearing 12*a* is sandwiched in the lower end of the guideway 13*i* in the slightly narrowed space which opens to the outside, and is stopped against the spring force of the compression coil spring 12*b*. When the charging roller 12 is pulled toward the transfer opening 13*n*, the charging roller bearing 12*a* expands the guideway 13*i* against the elastic force, and the assembled charging roller bearing 12*a* and compression coil spring 12*b* are dismounted. The charging roller 12 is first removed through the transfer opening 13*n*, and then the small screws 62 securing the cleaning blade 14 to the cleaning frame 13 are unthreaded, and thereafter, the cleaning blade 14 is removed. At this time, the small screws 62 are unthreaded by a ratchet driver or a similar electric driver having a cross-type tip end. If the amount of the toner removed from the surface of the photosensitive drum 11 and contained in the cleaning frame 13 is large, the toner is removed. This is done by vacuum suction using a suction nozzle (unshown) inside into the removed toner container portion through the transfer opening 13*n*. Simultaneously, the air may be supplied. After toner is removed from the cleaning frame 13, a new cleaning blade or the same cleaning blade 14 that has been removed, if it is reusable, is mounted by small screws 62 to the cleaning frame 13. In addition, a new charging roller or the removed charging roller 12 is mounted.

Figure 17:
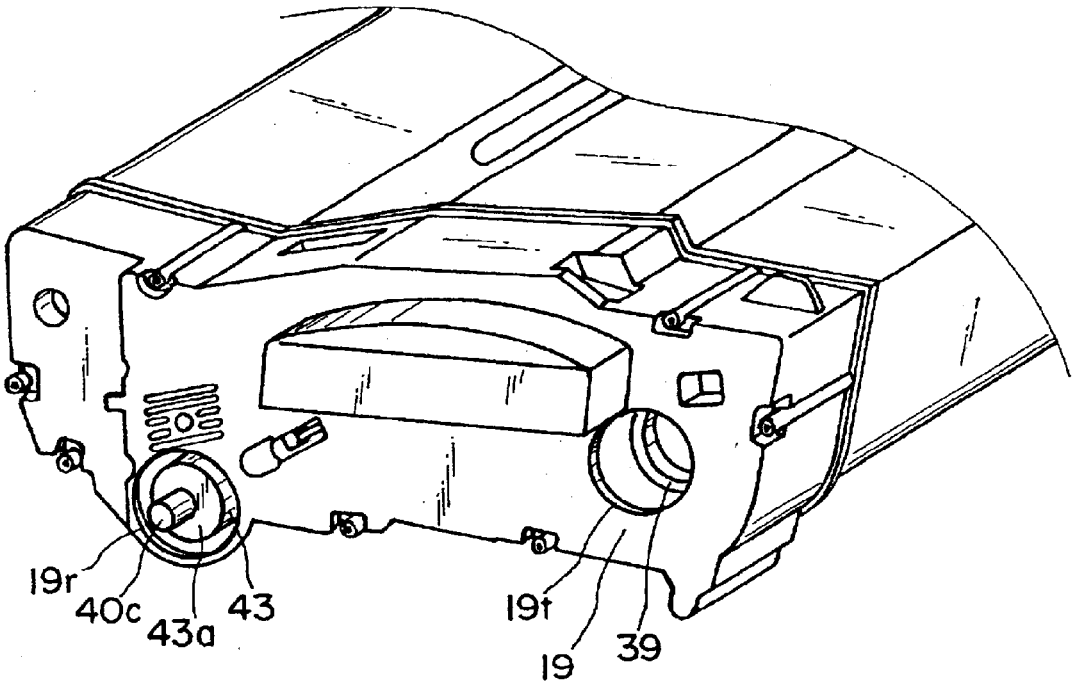
FIG. 17 is a perspective view around a side cover, illustrating a remanufacturing method of a process cartridge.

A description will be provided as to insertion of the photosensitive drum 11. If the photosensitive drum 11 is reusable, the removed one is remounted. When the photosensitive drum 11 is inserted into the cleaning frame 13, the process cartridge P is placed on the table such that the transfer opening 13*n* faces up, and is inclined such that flange portion 11*a* side takes a slightly upper position. Then, the flange portion 11*b* is inserted through the transfer opening 13*n* into a hole of the bearing 41. Thereafter, the flange portion 11*a* side is placed in the cleaning frame 13. The drum supporting shaft 40 is inserted through the hole 19*r* formed in the earlier step in the side cover 19. Then, the shaft portion 40*b* is engaged into the center hole of the flange 11*a*. The drum supporting shaft 40 is securedly fixed to the cleaning frame 13 by small screws 61. As shown in FIG. 17, a cylindrical positioning member 43 for positioning in the longitudinal direction is mounted to the shaft portion 40*c* of the drum supporting shaft 40 by press-fitting or adhesive material. An end surface 43*a* of the positioning member 43 takes substantially the same longitudinal position as the cut portion of the side cover 19, and when the process cartridge P is mounted to the main assembly C of the apparatus, it functions to determine the position of the process cartridge P in the longitudinal direction.

Here, the positioning member 43 is cylindrical, and the inner diameter of the hollow portion is substantially equal to the outer diameter of the shaft portion 40*c*. What is important is that position of the end surface 43*a* in the longitudinal direction relates to the position of the process cartridge P in the longitudinal direction when it is mounted to the main assembly C of the apparatus, and therefore, the configuration and the mounting method of the positioning member 43 may be modified in various ways.

Figure 18:
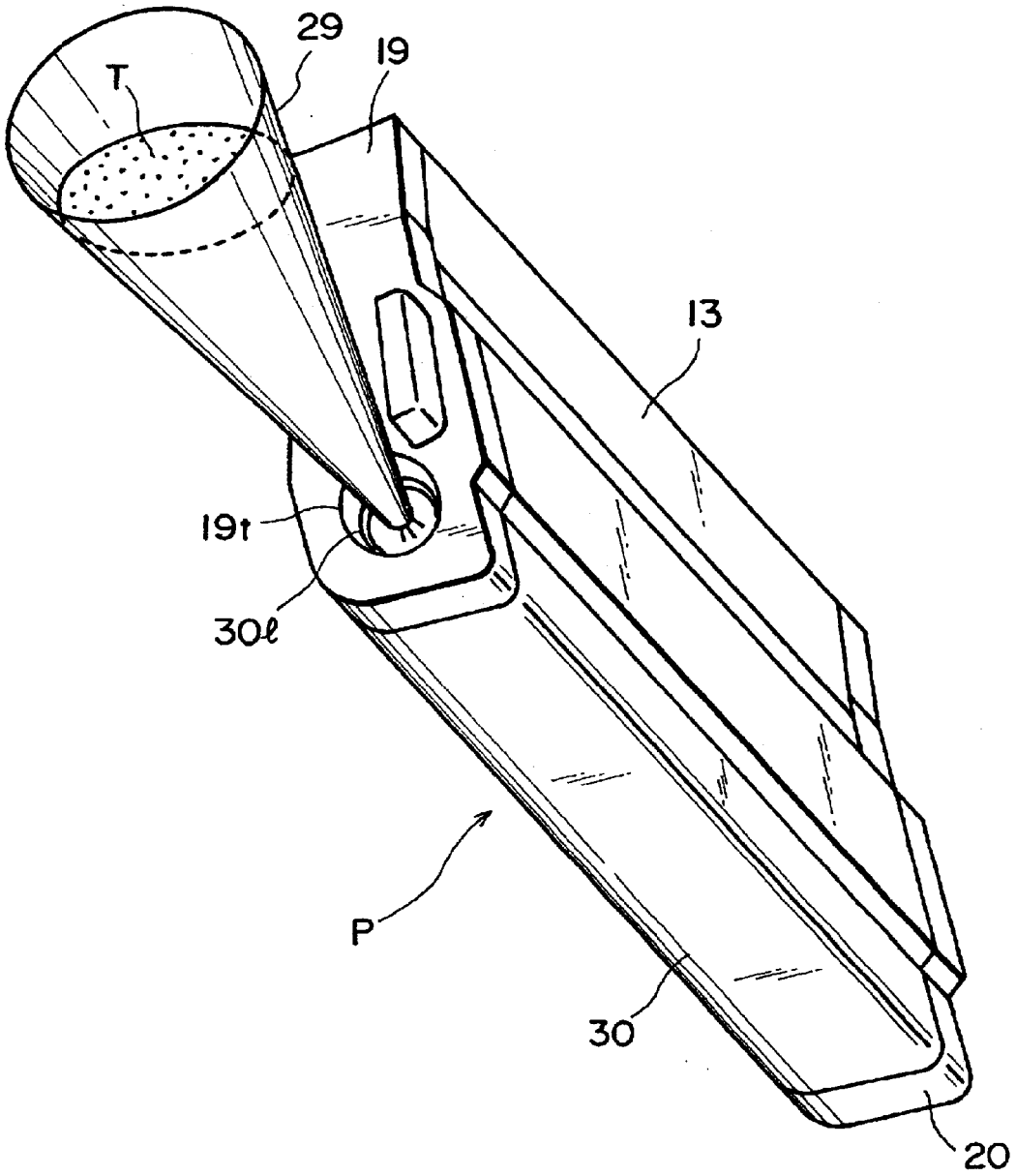
FIG. 18 is a perspective view, illustrating toner refilling operation in a remanufacturing method of a process cartridge.

Subsequently, the toner is filled. The toner cap 39 mounted to the toner filling opening 30*l* of the toner accommodating container 30 is removed through the hole 19*t* formed in the side cover 19, and as shown in FIG. 18, the filling port 30*l* is made to take a higher position, and then a funnel 29 is inserted into the filling port 30*l*. Then, a desired amount of the toner T is filled into the filling port 30*l*. After the toner is filled, the removed toner cap 39 is mounted if it is reusable. If the toner cap 39 is damaged, for example, a new toner cap is used to seal the filling port 30*l*. After the toner is filled into the toner accommodating container 30, the toner deposited around the filling port 30*l* is removed.

In this manner, the process cartridge P is remanufactured.

In this embodiment, in the photosensitive drum 11 removing step, the hole is formed in the side cover 19; the drum supporting shaft 40 is removed; the projected portions 13*e*, 13*f* and the part of the portion defining the short side of the transfer opening 13*n* is cut off; and then the photosensitive drum 11 is removed. However, the order of the steps is not limited to this. For example, in an alternative order, the projected portions 13*e*, 13*f* and the frame defining the short side of the transfer opening 13*n*, that is, a part of the bearing cover portions 13*h*, 30*m* is cut off, and then a hole is formed in the side cover 19, and thereafter, the drum supporting shaft 40 is removed, whereafter the photosensitive drum 11 is taken out. In this embodiment, the positioning member 43 is mounted after the drum supporting shaft 40 is mounted. However, the drum supporting shaft 40 may be mounted to the cleaning frame 13 after the positioning member 43 is mounted to the drum supporting shaft 40. When the toner filling opening is provided at the side cover 20 side, a hole is formed in the side cover 20 so that hole 19*t* is formed in the side cover 20, and the toner is filled.

As regards the refill of the toner, it would be considered that a hole is formed in a part of the toner accommodating container 30 or the toner accommodation cap 31 constituting the toner accommodating unit 16, not in the side cover 19, and the toner is filled through the hole, and then the hole is sealed by a tape or a plate material (sealing member). This, however, would result in falling of the chips of resin material into the toner accommodating container 30. According to this embodiment, the hole is formed in the side cover 19, and the toner cap 39 is removed, and thereafter, the toner is filled through the filling port 30*l*. Therefore, the problem does not arise.

Embodiment 2

Embodiment 2 of the present invention will be described. Since this embodiment is different from Embodiment 1 in the step of removing the photosensitive drum 11 only, the description will be provided only as to the points different from Embodiment 1.

In the photosensitive drum 11 removing step in Embodiment 1, the hole is formed in the side cover 19, and the drum supporting shaft 40 is removed, and then the projected portions 13*e*, 13*f* and the part of the frame defining the short side of a transfer opening is cut off, and thereafter, the photosensitive drum 11 is removed. In Embodiment 2, a part of the photosensitive drum 11 is cut off in place of cutting off a part of each of the bearing cover portions 13*h*, 30*m*, which is the frame defining the short side of the transfer opening, and then the photosensitive drum 11 is removed.

Figure 19:
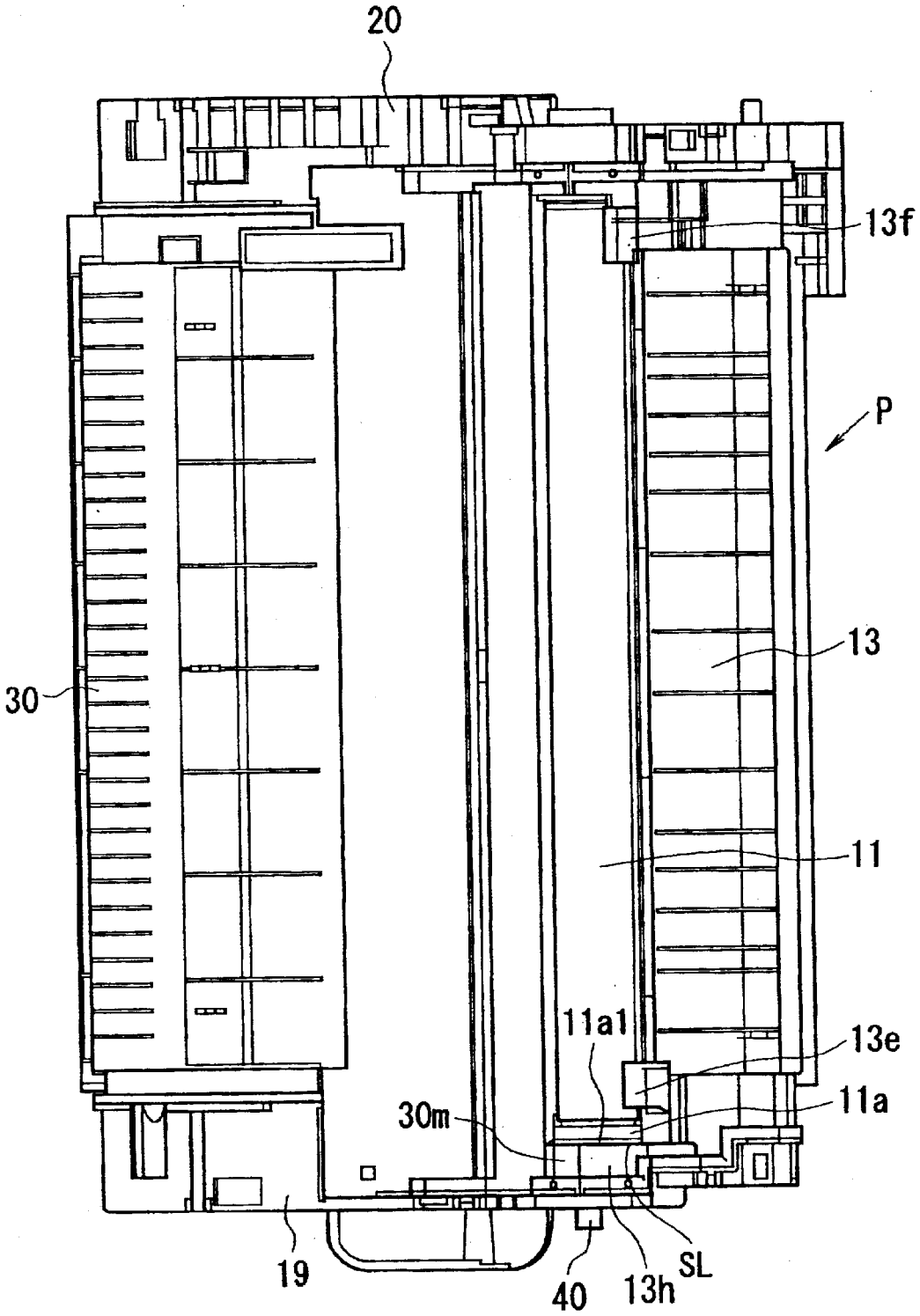
FIG. 19 is a bottom plan view of a process cartridge, illustrating a remanufacturing method of a process cartridge.

This will be described in detail. In FIG. 19, a thin cutter or the like is inserted through a gap SL between the flange 11*a* of the photosensitive drum 11 and the short side of the transfer opening 13*n*, and the guide portion 11*a*1 of the flange 11*a* is cut off. Then, similarly to Embodiment 1, the projected portions 13*e*, 13*f* are cut out. The side cover 19 is partly cut off around the drum supporting shaft 40 to form a hole 19*r*, and the drum supporting shaft 40 is taken out. Thereafter, the process cartridge P is remanufactured.

If the photosensitive drum 11 is not reusable due to wearing or the like, the central portion of the drum, rather than the guide portion 11*a*1, is cut to divide it into two parts, which are then taken out of the cleaning frame 13.

As described in the foregoing with respect to Embodiments 1 and 2, the hole is formed in the side cover 19, and the drum supporting shaft 40 is removed, and then the photosensitive drum 11 is taken out through the transfer opening 13*n*, thus disassembling the process cartridge P; the photosensitive drum 11 is inserted through the transfer opening 13*n*, and the drum supporting shaft 40 is mounted, and then the toner is filled, by which the process cartridge P is remanufactured.

In the process cartridge P described in the embodiments, the positioning in the longitudinal direction is carried out by the portion of the side cover 19 around the drum supporting shaft 40, and therefore, the positioning member 43 is mounted. When the other portion of the process cartridge is used for the positioning, it is not necessary to mount the positioning member 43.

Similarly, if the process cartridge P does not have the projected portions 13*e*, 13*f*, the step of cutting the projected portions 13*e*, 13*f* off is omitted; if the process cartridge P does not have the guide portion 11*a*1 of the flange 11*a*, it is not necessary to cut off the part of the frame defining the short side of the transfer opening 13*n* or the part of the photosensitive drum 11.

Those processes in the process cartridge remanufacturing methods in accordance with the present invention may be changed in order as necessary.

The above described embodiments of the present invention include a process cartridge remanufacturing method which involves simultaneously a substantial number of process cartridges with an expired service life, as well as a process cartridge remanufacturing method which involves a single process cartridge with an expired service life. In the case of the former, a substantial number of expired cartridges are recovered, and disassembled. Then, the components removed from the disassembled cartridges are sorted into groups of the identical components. Then, as large as possible a number of cartridges are reassembled from the groups of sorted recyclable components, and some brand-new replacement components for the nonrecyclable old components are used. In the case of the latter, the expired cartridges are remanufactured one by one. In other words, each time an expired cartridge is recovered, it is disassembled, and reassembled using the same old components removed therefrom, and some brand-new replacement components are used for the nonrecyclable old components, or some old recyclable components removed from the other recovered cartridges are used.

The present invention includes any of the following cases:

(1) each expired cartridge is overhauled using only the components therein;

(2) each expired cartridge is overhauled using, in principle, the components therein, with the exception of the brand-new replacement components, or the recyclable old components from the other expired cartridge, which replace the original components that are nonrecyclable due to service life expiration, damage, malfunctions, or the like;

(3) a plurality of expired cartridges are overhauled together; the components removed from the plurality of expired cartridges are sorted into groups of the identical components, and as large as possible a number of cartridges are reassembled using only the components from the groups of the original components; and (4) a plurality of expired cartridges are overhauled together; the components removed from the plurality of expired cartridges are sorted into groups of the identical components, and as large as possible a number of cartridges are reassembled using, in principle, the components from the groups of the original components, except for a certain number of brand-new replacement components which replace the original components that are nonrecyclable due to service life expiration, damages, malfunctions, or the like.

The aforementioned components are the structural components disclosed in the claim portion of this specification, that is, the components which make up the above described portions of the cartridge. It also includes the smallest components or units, into which the cartridge can be disassembled.

As described above, the present invention is a realization of a simple method for remanufacturing a process cartridge.

While the invention has been described with reference to the structures disclosed herein, it is not confined to the details set forth, and this application is intended to cover such modifications or changes as may come within the purposes of the improvements or the scope of the following claims.

What is claimed is:

1. A remanufacturing method for a process cartridge, wherein the process cartridge is detachably mountable to a main assembly of an electrophotographic image forming apparatus, and said process cartridge includes an electrophotographic photosensitive drum having, at one longitudinal end, a drive receiving portion configured and positioned to receive a driving force from the main assembly of the electrophotographic image forming apparatus; a drum frame rotatably supporting the electrophotographic photosensitive drum; a developing frame configured and positioned to support a developing roller configured and positioned to develop a latent image formed on the electrophotographic photosensitive drum; a developer frame accommodating a developer to be used for a developing operation of the developing roller; a first side cover fixed to one longitudinal end of the drum frame and to one longitudinal end of the developer frame; and a second side cover fixed to the other longitudinal end of the drum frame and to the other longitudinal end of the developer frame; an image transfer opening formed along a longitudinal direction of the electrophotographic photosensitive drum for permitting transfer of a visualized image provided by the developing roller onto a recording material; a drum supporting shaft having a flange portion fixed to the drum frame at the other longitudinal end of the drum frame, a first shaft portion inserted into the electrophotographic photosensitive drum, and a second shaft portion extending oppositely from the first shaft portion with the flange portion therebetween and extending through an opening of the second side cover, said method comprising:

(a) a first hole forming step of forming a first hole in the second side cover around the second shaft portion of the drum supporting shaft;

(b) a drum shaft removing step of removing the drum supporting shaft from the drum frame through the first hole formed by said first hole forming step;

(c) a photosensitive drum removing step of removing the electrophotographic photosensitive drum from said drum frame through the image transfer opening;

(d) a photosensitive drum insertion step of inserting the electrophotographic photosensitive drum into the drum frame through the image transfer opening;

(e) a drum shaft mounting step of mounting the drum supporting shaft on the drum frame; and (f) a refilling step of filling developer into the developer frame.

2. A process cartridge remanufacturing method according to claim 1, further comprising, in or after said drum shaft mounting step, a positioning member mounting step of mounting a positioning member configured and positioned to position in the longitudinal direction which is an axial direction of the electrophotographic photosensitive drum, around the second shaft portion of the drum supporting shaft such that the end surface of the positioning member is substantially aligned with an outer wall surface of the first hole of the second side cover with respect to the longitudinal direction of the photosensitive drum.

3. A process cartridge remanufacturing method according to claim 1 or 2, wherein said process cartridge further includes a projected portion projecting into the image transfer opening from the drum frame adjacent a longitudinal end portion of said image transfer opening, said method further comprising a projected portion removal step of removing the projected portion before the electrophotographic photosensitive drum is removed.

4. A process cartridge remanufacturing method according to claim 1 or 2 further comprising an opening expanding step of cutting off at least a part of a member defining a short side of the image transfer opening at the second side cover side of said process cartridge, before the electrophotographic photosensitive drum is removed.

5. A process cartridge remanufacturing method according to claim 1 or 2 further comprising a drum cut-off step of cutting off at least a part of the photosensitive drum.

6. A process cartridge remanufacturing method according to claim 1 or 2, wherein said process cartridge further includes a developer filling opening and a sealing member configured and positioned to seal the developer filling opening in either one of said one or the other ends of the developer frame, said method further comprising:

a second hole forming step of forming a second hole in either one of the first and second side covers that cover the developer filling opening, adjacent the developer filling opening;

a sealing member removing step of removing the sealing member through the second hole formed by said second hole forming step; and a sealing member mounting step of mounting the sealing member to the developer filling opening.

7. A process cartridge remanufacturing method according claim 1 or 2, wherein said process cartridge further includes a charging roller configured and positioned to charge the electrophotographic photosensitive drum, and a cleaning blade configured and positioned to remove the remaining developer from the electrophotographic photosensitive drum, said method comprising, between said photosensitive drum removing step and said photosensitive drum insertion step, a step of removing the charging roller and the cleaning blade; and a step of mounting the charging roller and the cleaning blade.

8. A process cartridge detachably mountable to a main assembly of an electrophotographic image forming apparatus, said process cartridge comprising:

an electrophotographic photosensitive drum having at one longitudinal end, a drive receiving portion configured and positioned to receive a driving force from the main assembly of the electrophotographic image forming apparatus;

a drum frame rotatably supporting said electrophotographic photosensitive drum;

a developing frame configured and positioned to support a developing roller configured and positioned to develop a latent image formed on said electrophotographic photosensitive drum;

a developer frame accommodating a developer to be used for a developing operation of said developing roller;

a first side cover fixed to one longitudinal end of said drum frame and to one longitudinal end of said developer frame; and a second side cover fixed to the other longitudinal end of said drum frame and to the other longitudinal end of said developer frame;

an image transfer opening formed along a longitudinal direction of said electrophotographic photosensitive drum for permitting transfer of a visualized image provided by said developing roller onto a recording material; and a drum supporting shaft having a flange portion fixed to the drum frame at the other longitudinal end of the drum frame, a first shaft portion inserted into said electrophotographic photosensitive drum, and a second shaft portion extending oppositely from said first shaft portion with said flange portion therebetween and extending through an opening of said second side cover, said process cartridge being remanufacturable by a method comprising:

(a) a drum shaft removing step of removing said drum supporting shaft from said drum frame;

(b) a photosensitive drum removing step of removing said electrophotographic photosensitive drum from said drum frame through said image transfer opening;

(c) a photosensitive drum insertion step of inserting said electrophotographic photosensitive drum into said drum frame through said image transfer opening;

(d) a drum shaft mounting step of mounting said drum supporting shaft on said drum frame; and (e) a refilling step of filling developer in said developer frame;

wherein said second side cover has a hole around said second shaft portion of said drum supporting shaft to permit said drum supporting shaft to be removed from said drum frame.

9. A process cartridge remanufacturing method according to claim 1, wherein the electrophotographic photosensitive drum inserted into the drum frame in said photosensitive drum insertion step is a re-used electrophotographic photosensitive drum.

10. A process cartridge according to claim 9, wherein said electrophotographic photosensitive drum inserted into said drum frame in said photosensitive drum insertion step is a re-used electrophotographic photosensitive drum.

* * * * *

UNITED STATES PATENT AND TRADEMARK OFFICE

CERTIFICATE OF CORRECTION

PATENT NO. : 6,856,775 B2
DATED : February 15, 2005
INVENTOR(S) : Sekine

It is certified that error appears in the above-identified patent and that said Letters Patent is hereby corrected as shown below:

Column 1,
Line 59, “forms” should read -- form --.

Column 4,
Line 33, “data As” should read -- data. As --.
Line 56, “drum 1,” should read -- drum 11, --.

Column 5,
Line 2, “drum 1” should read -- drum 11, --.
Line 38, “portion 11*al*” should read -- 11a1 --.

Column 6,
Line 19, “is fold” should read -- is folded --.
Line 59, “21 a” should read -- 21a --.

Column 8,
Line 26, “(FIGS. 3)” should read -- (FIG. 3) --.

Column 9,
Line 19, “(el)” should be deleted.

Column 10,
Line 30, “30*l* (el)”should read -- 30*l*, --.
Line 32, “(el)” should be deleted.
Line 44, “(a” should read -- (an --.

UNITED STATES PATENT AND TRADEMARK OFFICE

CERTIFICATE OF CORRECTION

PATENT NO. : 6,856,775 B2
DATED : February 15, 2005
INVENTOR(S) : Sekine

It is certified that error appears in the above-identified patent and that said Letters Patent is hereby corrected as shown below:

Column 14,
Line 22, “claim” should read -- claims --.

Column 16,
Line 62, “claim 9” should read -- claim 8 --.

Signed and Sealed this

Twenty-third Day of August, 2005

JON W. DUDAS
*Director of the United States Patent and Trademark Office*